US009990910B2

(12) United States Patent
Steinberger

(10) Patent No.: US 9,990,910 B2
(45) Date of Patent: Jun. 5, 2018

(54) LOCKING STRAP MECHANISM

(71) Applicant: Richard Ned Steinberger, Nobleboro, ME (US)

(72) Inventor: Richard Ned Steinberger, Nobleboro, ME (US)

(73) Assignee: D'Addario & Company, Inc., Farmingdale, NY (US)

( * ) Notice: Subject to any disclaimer, the term of this patent is extended or adjusted under 35 U.S.C. 154(b) by 59 days.

(21) Appl. No.: 15/401,152

(22) Filed: Jan. 9, 2017

(65) Prior Publication Data

US 2017/0206871 A1 Jul. 20, 2017

Related U.S. Application Data

(60) Provisional application No. 62/279,157, filed on Jan. 15, 2016, provisional application No. 62/334,679, filed on May 11, 2016.

(51) Int. Cl.
*G10G 5/00* (2006.01)
*A44B 17/00* (2006.01)

(52) U.S. Cl.
CPC ..... *G10G 5/005* (2013.01); *A44B 17/007* (2013.01); *A44B 17/0076* (2013.01)

(58) Field of Classification Search
CPC ..... G10G 5/005; G10G 5/00; A44B 17/0076; A44B 17/007
See application file for complete search history.

(56) References Cited

U.S. PATENT DOCUMENTS 6,080,922 A * 6/2000 Dimbath ..... G10G 5/005 84/327
7,045,694 B2 * 5/2006 Yasunori ..... A44B 11/2584 24/633

* cited by examiner

*Primary Examiner* — Kimberly Lockett
(74) *Attorney, Agent, or Firm* — Law Offices of Daniel A. Tesler, LLC

(57) ABSTRACT

An automatically actuating strap lock mechanism for use on instruments is disclosed. The multiple embodiments disclosed herein use an automatically actuating retaining mechanism to allow a user to attach the end of a strap to a strap button on an instrument without having to manipulate a lever or knob. The retaining mechanism is capable of being moved into the open position using the head of a strap button, allowing a user to slide the mechanism over a strap button. Once a strap button is seated in the strap lock mechanism, the retaining mechanism is automatically released, locking the strap button in place.

20 Claims, 18 Drawing Sheets

LOCKING STRAP MECHANISM

CROSS REFERENCE TO RELATED APPLICATIONS

This application claims the benefit of U.S. Provisional Patent Application No. 62/279,157 filed Jan. 15, 2016 and U.S. Provisional Patent Application No. 62/334,679 filed May 11, 2016, which are hereby incorporated by reference in their entirety.

FIELD OF THE INVENTION

The present invention relates to straps for use with guitars and other portable musical instruments.

BACKGROUND OF THE INVENTION

Guitars and other musical instruments are commonly equipped with strap buttons, sometimes called end pins, that are used to attach straps for holding the instrument in position while playing it. Many types of instruments can use strap buttons, however, they are particularly prevalent in string instruments that are suspended by a strap in front of the player of the instrument (hereinafter "player" or "user"). The strap generally attaches to a first strap button, extends upward around the back of a player's neck and then attaches to a second strap button. With both ends of the strap fixed to a strap button, the height of the instrument relative to a player's neck can be adjusted by lengthening or shortening the strap.

Strap buttons are generally fixed on or near the body of a guitar or other stringed instrument to provide mounting points for attaching a strap. Common locations for strap buttons on guitars include, but are not limited to, the area near or on the neck joint, the horn and the bottom of the guitar, the bottom of the guitar being the end facing downward when the neck is pointing upward. Strap buttons are generally about one half of an inch in diameter near its top, where the top of the strap button is the end furthest from the instrument's body. Between the top of a strap button and its base, the end fixed to a guitar's body, is a circumferential groove that holds a strap end (hereinafter "strap end" or "end of a strap"). The point where the circumferential groove is at its smallest diameter is also referred to herein as the "narrow portion" or "narrow middle portion" of a strap button.

The dimensions and shape of strap buttons can vary considerably among the various manufacturers and product lines. The height of the strap button, diameter of the top and diameter of the circumferential groove can vary, making it difficult for a single style of strap end to fit all strap buttons. To accommodate the variations in strap buttons, conventional straps use a leather end configured to accept most strap buttons. The leather end usually has a hole that is approximately the same diameter as the circumferential groove on most strap buttons and a cut portion extending away from the center of the hole in the radial direction. The cut portion allows the opening in the strap end to fit over the top of the strap button.

The use of leather strap ends, however, does not come without its drawbacks. The strap can accidently pull off the button, causing a valuable guitar to fall and incur damage. Wear of the leather makes the strap more likely to come off the strap button unexpectedly. Even when new, the strap end can slip off the strap button when the instrument is being played or moved.

Various systems for fixing the ends of straps to guitars have been developed, generally called strap locks, but they are all cumbersome to install and use. Existing strap locks that provide a more secure attachment than a traditional leather strap end require specialized strap buttons and are not easily attached or removed with one hand. The use of a specialized strap button requires the use of tools to install and once installed, it prevents a player from swapping between straps designed to mate with the specialized strap button and straps with traditional leather strap ends. In addition, the strap locks of the prior art require the use of tools to attach a locking mechanism to a traditional leather strap end. Even when attached with tools, hardware attached to leather can loosen over time as the leather dries, causing the locking mechanism to separate from the strap end.

Accordingly, it is an object of the present invention to provide an apparatus for securely attaching a strap end to a strap button. It is a further object of the invention to provide a locking strap mechanism that is easy to install and remove with a single hand and that can be installed without the use of tools. Furthermore, it is an object of the invention to provide a locking strap mechanism that installs with an automatically latching component, without a user needing to manipulate a lever, knob, fastener, etc.

BRIEF SUMMARY OF THE INVENTION

The present invention provides a mechanism to securely attach the end of a strap to a strap button on an instrument. In particular, the present invention provides a mechanism that can be easily installed over a strap button by a user with an automatically latching component that retains the strap button within the mechanism.

The first to fourth embodiments of the invention are adapted to be compatible with a generic style of strap button that is cylindrical, with a wide top portion and narrow middle portion. The top portion of a strap button refers to the end of the strap button furthest from the surface of the instrument and middle refers to a location on the outside of the strap button that is between the top and the surface of the instrument, generally centered over a circumferential groove. While a generic style strap button is shown in the figures for the first to fourth embodiments, this invention may be adapted, within the inventive concept, to the other styles of strap buttons available.

The invention has application to all classes or families of musical instruments that are desired to be suspended from a strap, including but not limited to guitars, basses, banjos, and lutes. Such instruments may have one or more strap buttons fixed to their surface to allow a strap to be attached. Straps attached to strap buttons may be used while the instrument is in use or for storage purposes.

For clarity, representative structures of strap ends commonly used for musical instruments are shown in the drawings. While only a couple styles of strap end are shown in the drawings, those skilled in the art will readily appreciate how the mechanism described would be integrated into a particular strap or strap end. The invention may be installed at both or either end of a strap, depending on the particular situation.

In a first embodiment of the invention is a strap lock mechanism integrated within a multi-layer strap end. In the strap lock mechanism, a mounting plate with a u-shaped slot is situated between the layers of the strap end and fixed to a pivot plate located on the exterior of the strap end. Rotatably attached to the pivot plate is a retaining lever with a protrusion extending downward from the end furthest from the axis of rotation. A torsion spring is coupled to the retaining lever and pivot plate to push the protrusion downward. The protrusion on the upper arm may be rotated upward, allowing the u-shaped slot to engage with the narrow portion of a strap button. The u-shaped slot is narrower than the diameter of the wide portion of the strap button so that the strap button may not be pulled downward, once seated in the u-shaped slot. With the strap button fully seated in the u-shaped slot, the retaining lever can be released, the force of the torsion spring causing it to snap downward, placing the protrusion adjacent to the strap button. In this position, the strap button is locked into place by the retaining lever and u-shaped slot in the up and down directions, the sides of the u-shaped slot in the side to side and forward directions and by the protrusion in the rearward direction.

In a second embodiment is a strap lock mechanism configured to be attached to the looped end of a strap. In the strap lock mechanism, a lower arm, a retaining lever and an integral spring are constructed as a single piece. The retaining lever is fixed to the integral spring on one end and is further comprised of a downward facing protrusion on the other end. The lower arm is fixed to the integral spring on one end and is further comprised of a u-shaped slot open to a larger opening and an elongated opening to attach a strap. The integral spring provides a point of rotation for the retaining lever relative to the lower arm, resisting motion in both directions. The protrusion on the upper arm may be rotated upward, allowing the u-shaped slot to engage with the narrow portion of a strap button. The u-shaped slot is narrower than the diameter of the wide portion of the strap button so that the strap button may not be pulled downward, once seated in the u-shaped slot. With the strap button fully seated in the u-shaped slot, the retaining lever can be released, the force of the integral spring causing it to snap downward, placing the protrusion adjacent to the strap button. In this position, the strap button is locked into place by the retaining lever and u-shaped slot in the up and down directions, the sides of the u-shaped slot in the side to side and forward directions and by the protrusion in the rearward direction.

In a third embodiment of the invention is a strap lock mechanism configured to be attached to the looped end of a strap. The strap lock mechanism is comprised of a lower arm and a retaining lever rotatably attached about a pin at a first end. The lower arm is further comprised of a u-shaped slot open to a larger opening and an elongated opening to attach a strap. The retaining lever is further comprised of a circular opening configured to clamp over a strap button and two edges designed to allow a user rotate the retaining lever relative to the lower arm. A torsion spring is coupled to the retaining lever and lower arm to push the circular opening of the retaining lever downward. The circular opening on the retaining lever may be rotated upward, allowing the u-shaped slot to engage with the narrow portion of a strap button. The u-shaped slot is narrower than the diameter of the wide portion of the strap button so that the strap button may not be pulled downward, once seated in the u-shaped slot. With the strap button fully seated in the u-shaped slot, the retaining lever can be released, the force of the torsion spring causing it to snap downward, placing the circular opening around the sides of the strap button. In this position, the strap button is locked into place by the u-shaped slot in the up and down, side to side and forward directions. The strap button is locked in place in the rearward direction by the inside of the circular opening. The strap button may alternatively be locked in the side to side and forward directions by the inside of the circular opening.

In a fourth embodiment of the invention is a strap lock mechanism configured to be attached to the looped end of a strap. The strap lock mechanism is comprised of a lower arm and a retaining lever rotatably attached about a pin at a first end. The lower arm is further comprised of a u-shaped slot open to a larger opening and an elongated opening to attach a strap. The retaining lever is further comprised of a circular opening configured to clamp over a strap button and an edge designed to allow a user rotate the retaining lever relative to the lower arm. A torsion spring is coupled to the retaining lever and lower arm to push the circular opening of the retaining lever downward. The circular opening on the retaining lever may be rotated upward, allowing the u-shaped slot to engage with the narrow portion of a strap button. The u-shaped slot is narrower than the diameter of the wide portion of the strap button so that the strap button may not be pulled downward, once seated in the u-shaped slot. With the strap button fully seated in the u-shaped slot, the retaining lever can be released, the force of the torsion spring causing it to snap downward, placing the circular opening around the sides of the strap button. In this position, the strap button is locked into place by the u-shaped slot in the up and down, side to side and forward directions. The strap button is locked in place in the rearward direction by the inside of the circular opening. The strap button may alternatively be locked in the side to side and forward directions by the inside of the circular opening.

In a fifth embodiment of the invention is a strap lock mechanism configured to be attached to the looped end of a strap. The strap lock mechanism is comprised of a body with a u-shaped slot fixed to its bottom and a retaining pin that slides vertically through the body. The retaining pin is coupled to a knob and spring assembly providing a downward force on the retaining pin. The retaining pin may be moved upward by grasping and pulling the knob upward, allowing the u-shaped slot to engage with the narrow portion of a strap button. The u-shaped slot is narrower than the diameter of the wide portion of the strap button so that the strap button may not be pulled downward, once seated in the u-shaped slot. With the strap button fully seated in the u-shaped slot, the knob can be released, the force of the spring causing the retaining pin to snap downward, preventing the strap button from sliding out of the u-shaped slot. In this position, the strap button is locked into place by the body and u-shaped slot in the up and down directions. The strap button is locked in place in the side to side and rearward directions by the sides of the u-shaped slot and in the forward direction by the retaining pin.

DETAILED DESCRIPTION OF THE INVENTION

In FIGS. 1-9 is a first embodiment of the invention, a locking strap mechanism 110 capable of positively attaching a strap end 111 to a strap button 130 fixed to an instrument 131. While most of the embodiments of the present invention have been adapted for use with a generic strap button 130, it is understood that the invention can be adapted to various styles of strap buttons within the inventive concept expressed herein.

Figure 1:
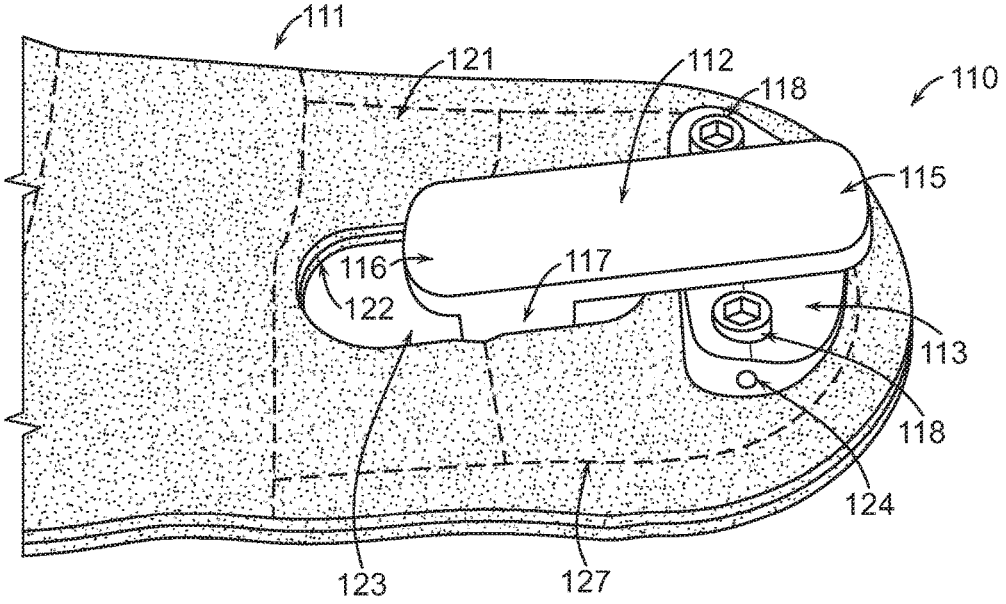
FIG. 1 is a top perspective view of a first embodiment of the invention shown in the closed position.

In FIG. 1 is a top perspective view of a first embodiment of the locking strap mechanism 110 mounted to a strap end 111. In the first embodiment, the locking strap mechanism 110 is comprised of a spring-loaded retaining lever 112, a pivot plate 113 and a mounting plate 114 (visible in FIGS. 3-5) that provides an anchoring point for the pivot plate 113. The retaining lever 112 is further comprised of a first end 115, a distal end 116, a protrusion extending downward from the distal end 116 and mounting ears 128 extending downward from the first end 115. The pivot plate 113 is generally u-shaped when viewed from above, with the opening facing towards the distal end of the retaining lever 112. The pivot plate 113 is further comprised of a cylindrical opening 124 that is horizontal and normal to the direction of the u-shaped opening, extending through the sides of the pivot plate and the void created by the u-shaped opening. The mounting ears 128 of the retaining lever 112 extend downward into the void in the pivot plate 113 and a pin 125 passes through the opening 124 and the mounting ears 128. The retaining lever 112 is rotatably coupled to the pivot plate 113 about the pin 125, allowing the distal end 116 to move in a radial arc about the longitudinal axis of the pin 125. The retaining lever 112 is pushed downward along its radial arc by a torsion spring 126 (visible in FIGS. 7-9) mounted about the pin 125.

In this embodiment, top or upward refers to the retaining lever 112 end of the locking strap mechanism 110 and bottom or downward refers to the mounting plate 114 end of the mechanism 110. Front refers to the direction of the first end 115 of the locking strap mechanism 110, rear refers to the direction of the distal end 116 and side refers to a direction perpendicular to a line running from the first end 115 to the distal end 116.

In the first embodiment of the locking strap mechanism 110, the mounting plate 114 is located at the center of the strap end 111 between an upper layer 121 and lower layer 122. While mostly hidden by the strap end 111 in FIG. 1, the mounting plate 114 is visible in FIGS. 3-5 where the strap end 111 has been cut away for clarity. The mounting plate is held in place between the upper layer 121 and the lower layer 122 with optional stitching 127. The locking mechanism 110 may alternatively attach to the strap end 111 using a loop or it may be sewn or glued into the leather or fabric of the strap. When the rigid components of the locking strap mechanism 110 are sewn or glued between the layers of a strap end 111, there is an added benefit of shielding the instrument 131 from damage. When the strap end 111 leather or fabric is located below the locking strap mechanism 110, no matter what angle the strap is pulled, the rigid portions of the mechanism cannot come into direct contact with the instrument 131 where it might scratch or damage it.

In the first embodiment, the pivot plate 113 is fixed to the mounting plate 114, sandwiching a portion of the upper layer 121 between the components. The mounting plate 114 has an overall u-shape and contains a u-shaped slot 119 to hook or engage the narrow portion of a strap button 130. In this embodiment, the pivot plate 113 is fixed to the mounting plate 114 with fasteners 118, however, it is appreciated that the fasteners 118 pictured are only one of many means available to fix the pivot plate 113 and mounting plate 114 on opposite sides of the upper layer 121. Substitutes for the fasteners 118 include but are not limited to adhesives, rivets, other threaded fasteners or a welding process.

Located partially below the protrusion 117 is an opening 123 that extends through both the upper layer 121 and lower layer 122 of the strap end 111. The opening 123 is wider than the diameter of the wide end of the strap button 130, allowing the strap button to freely pass through the opening 123. The opening 123 is ideally oblong in shape to allow a strap button to be freely inserted at the rear end and slid forward towards the u-shaped slot 119 in the mounting plate 114.

The locking strap mechanism 110 is in the closed position when the distal end 116 of the retaining lever 112 is located at the bottom of its arc and a strap button 130 has not been inserted into the device. In the closed position, the protrusion 117 is located at its lowest position and a strap button cannot be inserted into the locking strap mechanism 110 without rotating the retaining lever 112 upward. The locking strap mechanism 110 is in the locked position when the distal end 116 of the retaining lever 112 is located at the bottom of its arc and a strap button 130 has been inserted into the device. In the locked position, the protrusion 117 is pushed downward by the torsion spring 126, limited by the top of the strap button 130. In the locked position, the wide upper portion of the strap button 130 is trapped in the space between the bottom of the retaining lever 112 and the top of the u-shaped slot 119 in the up and down directions, the u-shaped slot 119 in the side to side and forward directions and the side of the protrusion 117 in the rearward direction. When in the locked position, the strap button 130 is still capable of a limited amount of motion relative to the strap lock mechanism 110 and is free to rotate relative to the strap lock mechanism 110. The locking strap mechanism 110 is in the open position when the distal end 116 of the retaining lever 112 is located at or near the top of its arc, allowing a strap button 130 to freely be inserted or removed from the device.

Figure 2:
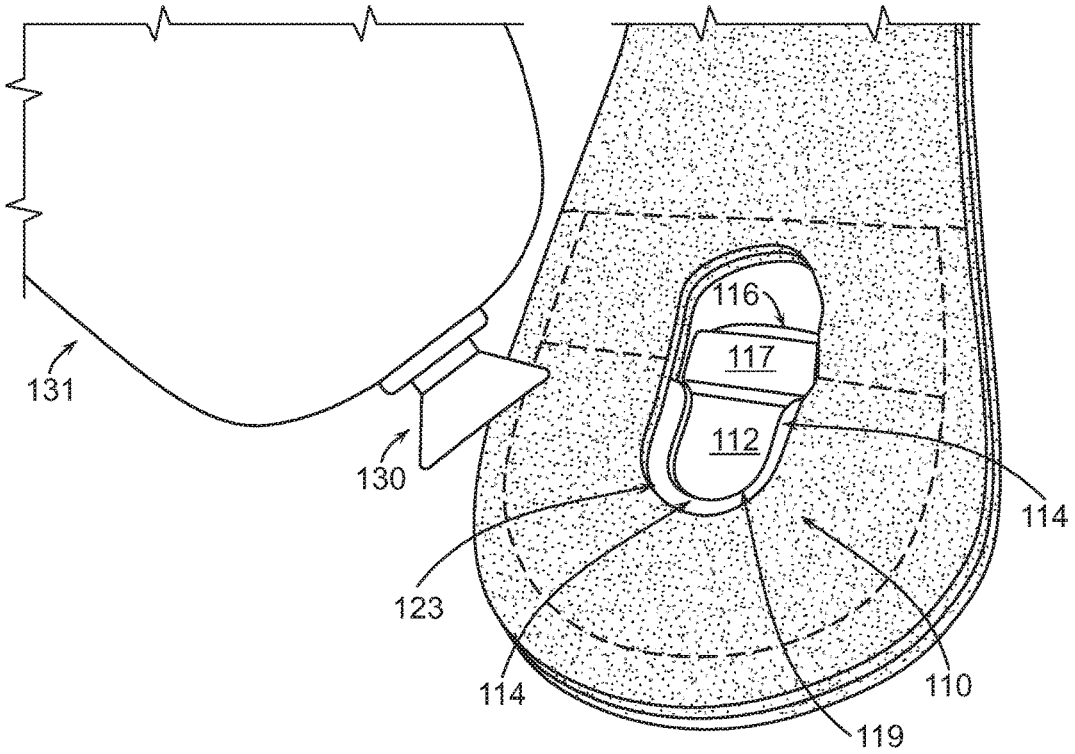
FIG. 2 is a bottom perspective view of the first embodiment of the invention shown in the closed position with a strap button shown.

In FIG. 2 is a bottom perspective view of the locking strap mechanism 110 showing the bottom of the device through the opening 123. A strap button 130 attached to an instrument 131 is also pictured. The strap button 130 pictured is exemplary in nature and other styles of strap buttons could be used with the invention. The invention could also be adapted, within the inventive concept expressed herein, to accommodate a different type or style of strap button. The instrument 131 pictured and the location of the strap button 130 is also exemplary in nature. The instrument 131 can be any type of instrument that would benefit from being suspended from a strap and the strap button 130 can be fixed to any location on the instrument 131 that is desirable to the user.

In FIG. 2, the locking strap mechanism 110 is in the closed position with the distal end 116 of the retaining lever 112 at the lowest position of its arc. In the closed position, the protrusion 117 is at its closest position to the mounting plate 114. The u-shaped slot 119 in the mounting plate 114 is narrower than the opening 123 and narrower than the diameter of the top of the strap button 130. The wide top of the strap button 130 can pass freely through the opening 123, but not through the u-shaped slot 119 in the mounting plate 114.

Figure 3:
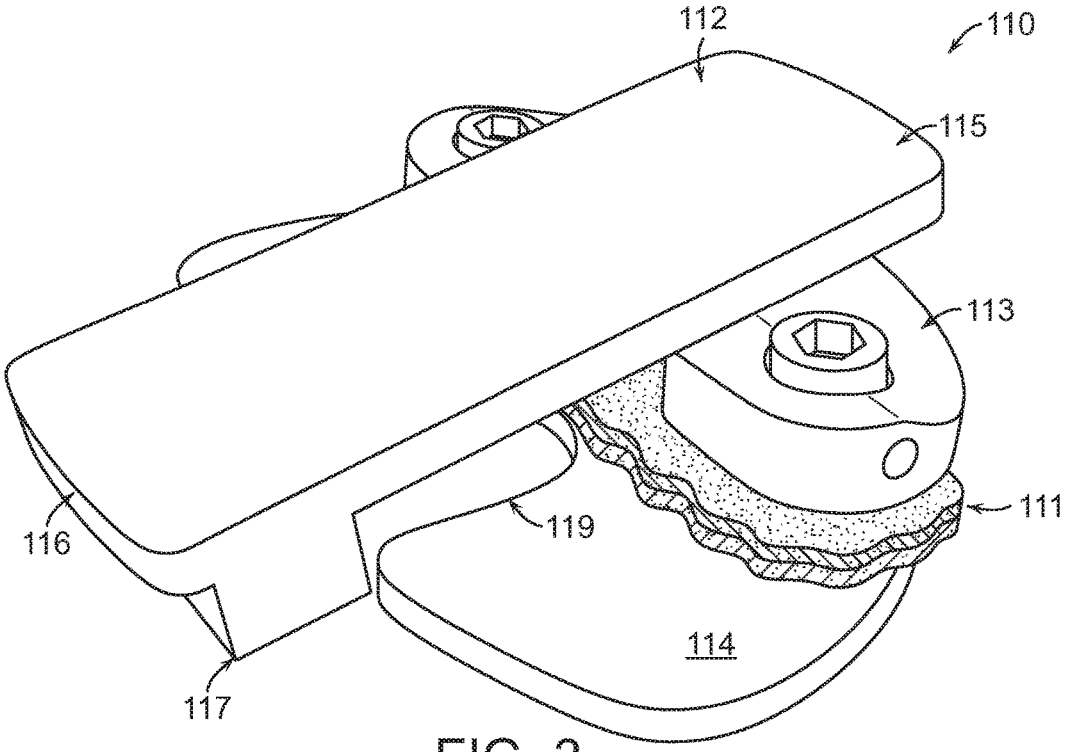
FIG. 3 is a top perspective view of a first embodiment of the invention with the strap cut away and shown in the closed position.

In FIG. 3 is a top perspective view of the locking strap mechanism 110 with most of the strap end 111 cut away to more clearly show the shape and configuration of the mounting plate 114. The mounting plate 114 has an overall u-shape when viewed from above and contains a u-shaped opening 119 to engage the narrow portion of a strap button 130. In FIG. 3, the locking strap mechanism 110 is in the closed position with the distal end 116 at the lowest point in its arc and the protrusion 117 at its closest point to the mounting plate 114. From the closed position, the distal end 116 and protrusion 117 would need to be lifted to a higher point in their arc to allow the wide end of a strap button 130 to be inserted into the u-shaped slot 119.

Figure 4:
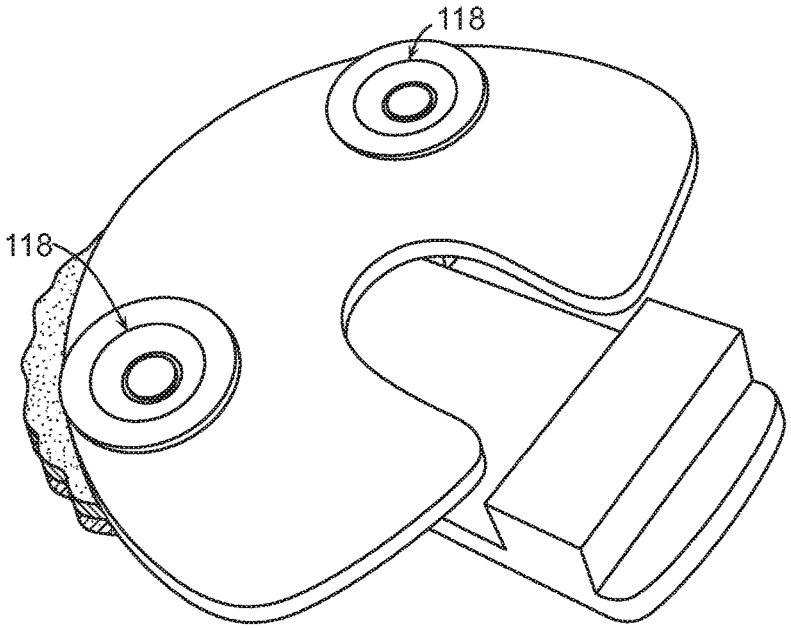
FIG. 4 is a bottom perspective view of the first embodiment of the invention with the strap cut away and shown in the closed position.

In FIG. 4 is a bottom perspective view of the locking strap mechanism 110 in the closed position, also with most of the strap end 111 cut away to more closely show the shape and configuration of the mounting plate 114. The portions of fasteners 118 that attach to the mounting plate 114 can be seen from the bottom when the strap end 111 is cut away.

Figure 5:
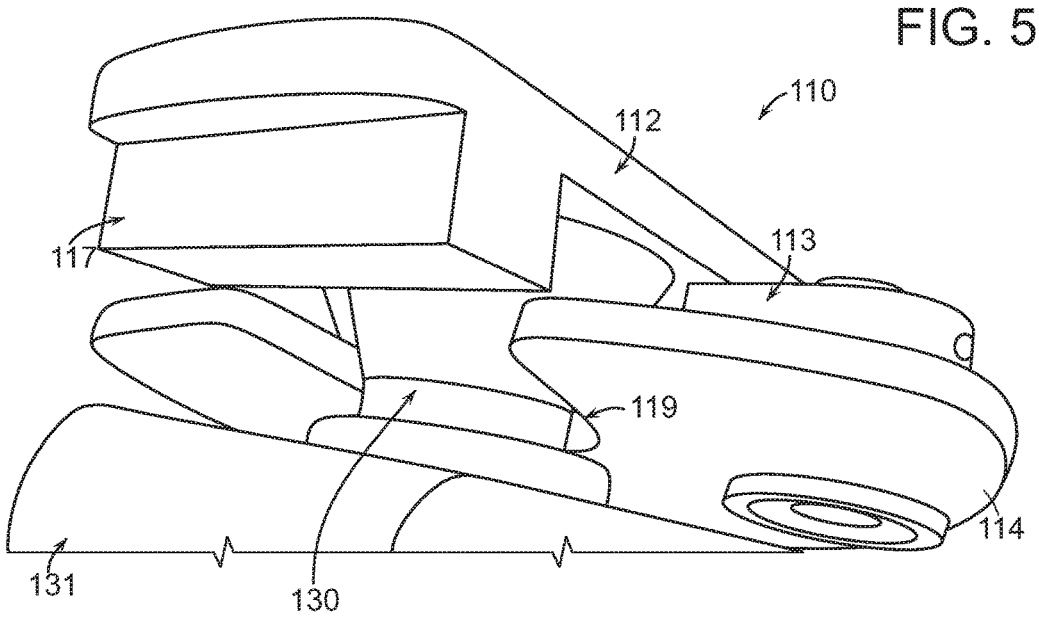
FIG. 5 is an alternative bottom perspective view of the first embodiment of the invention with the strap cut away and shown in the locked position over a strap button.

In FIG. 5 is a lower perspective view of the locking strap mechanism 110 in the locked position over a strap button 130. The strap button 130 is mounted to an instrument 131 and the strap end 111 is cut away in FIG. 5 for additional clarity. When in the locked position, the wide top end of the strap button 130 is located in the void between the bottom of the retaining lever 112 and the top of the u-shaped slot 119 in the up and down direction, the sides of the u-shaped slot 119 in the side to side and forward directions and the side of the protrusion 117 in the rearward direction. The u-shaped slot 119 engages the narrow middle portion of the strap button 130, preventing the strap button from passing downward out of the locking strap mechanism 110.

Figure 6:
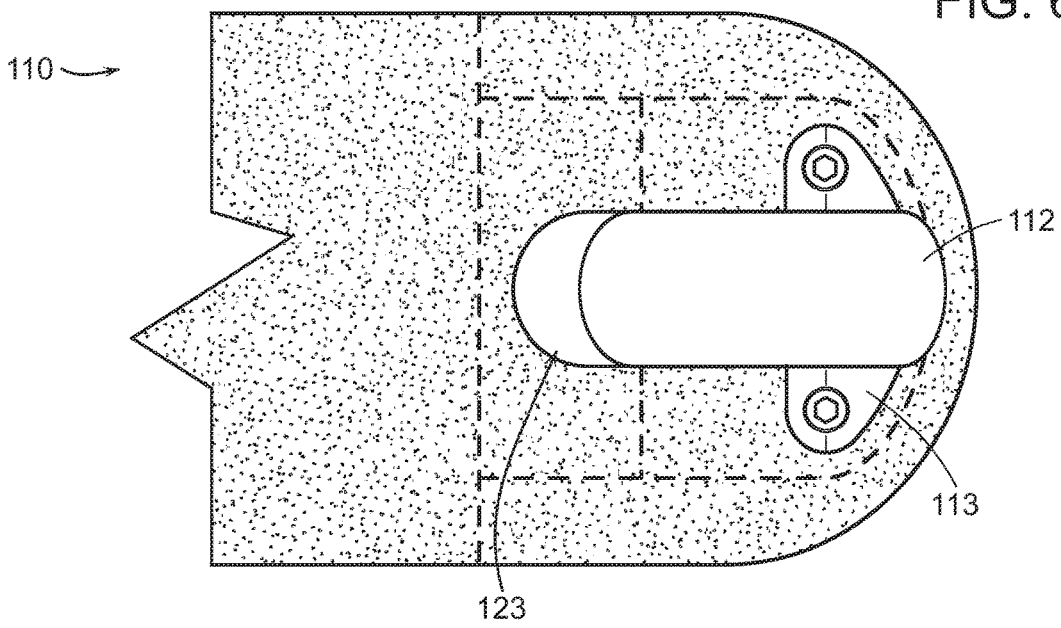
FIG. 6 is a top view of the first embodiment of the invention shown in the closed position.
Figure 7:
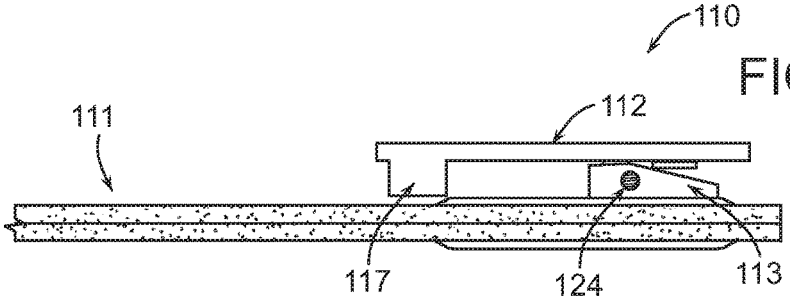
FIG. 7 is a side view of the first embodiment of the invention shown in the closed position.

In FIG. 6 is a top view and FIG. 7 is a side view of the locking strap mechanism 110 in the closed position. Only one side of the locking strap mechanism 110 is shown because the opposite side is a mirror image. In the first embodiment of the locking strap mechanism 110, the opening 123 in the strap end 111 is approximately the same width as the upper arm 112 so that the strap button would be hidden in the top view if inserted. The width and length of opening 123 may be increased or decreased as long as the strap button 130 is still capable of passing through the opening. The opening 123 also extends away from the mounting plate 114 for a distance equal to or greater than the diameter of the strap button 130 to allow the strap button 130 to freely pass through the opening 123.

Figure 8:
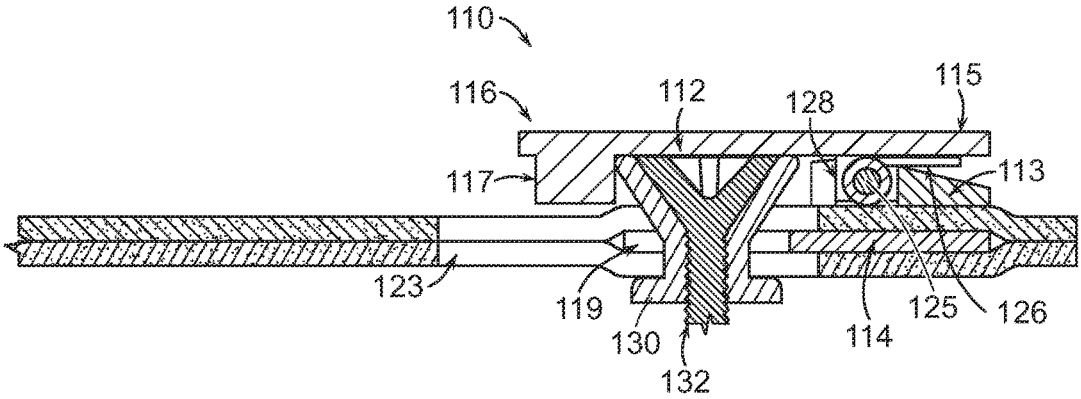
FIG. 8 is a side sectioned view of the first embodiment of the invention shown in the locked position over a strap button.
Figure 9:
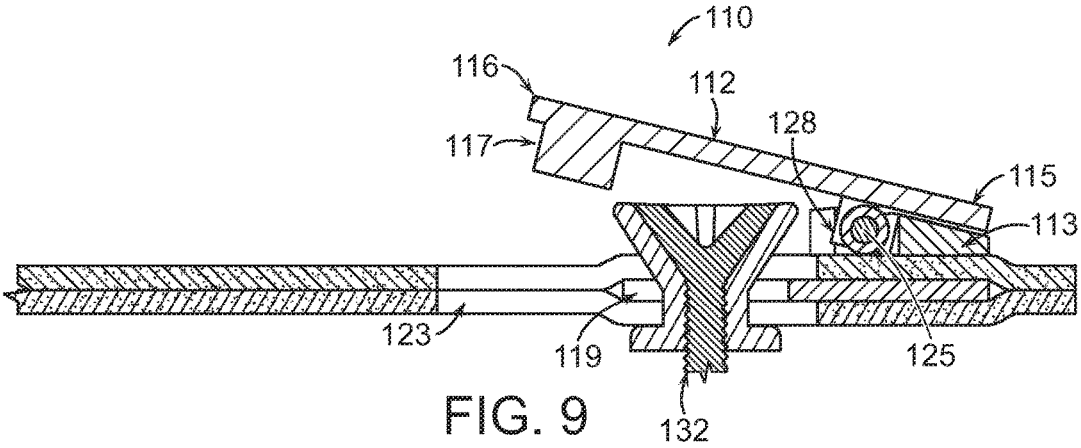
FIG. 9 is a side sectioned view of the first embodiment of the invention shown in the open position over a strap button.

In FIGS. 8 & 9 are side sectioned views of the first embodiment of the locking strap mechanism 110, sectioned through a vertical plane oriented along the front to rear axis and centered on the device from side to side. In FIG. 8, the locking strap mechanism 110 is in the locked position over a strap button 130 secured to an instrument with screw 132. When in the locked position, the retaining lever 112 is at an intermediate position within its range of motion about the longitudinal axis of the pin 125. The retaining lever 112 is rotatably coupled to the pivot plate 113 about the pin 125, allowing the distal end 116 to move in an arc centered on the longitudinal axis of the pin 125. When in the locked position, the top of the strap button 130 provides the lower stop in the retaining lever's 112 range of motion. The retaining lever 112 is pushed downward along its arc by the torsion spring 126 mounted about the pin 125. In the locked position, the torsion spring 126 causes the retaining lever 112 to put downward pressure on the top of the strap button 130. The strap button 130 is pushed down so that the sides of the strap button are pushed against the sides and/or top of the u-shaped slot 119 in the mounting plate 114.

In FIG. 9, the strap lock mechanism 110 is in the open position with a strap button 130 inserted into the u-shaped slot 119. In the open position, the retaining lever 112 is rotated about the pin 125 so that the distal end 116 is at the highest point in its arc. While the distal end 116 is shown at its highest point in its arc in FIG. 9, for the locking strap mechanism 110 to be in the open position, the protrusion 117 need only be raised high enough to allow the strap button 130 to be removed from the u-shaped slot 119. In this embodiment, the range of motion of the protrusion 117 and distal end 116 are limited in the upward direction when the bottom of the first end 115 of the retaining lever 112 contacts the top of the pivot plate 113.

Multiple methods may be used to bring the strap lock mechanism 110 into the open position. A user may lift the distal end 116 to raise the protrusion 117 an adequate amount to allow the strap button 130 to slide freely in or out of the u-shaped slot 119. A user may alternatively press down on the first end 115 of the upper arm 112 to raise the protrusion 117 an adequate amount to allow the strap button to slide freely in or out of the u-shaped slot 119.

The strap lock mechanism 110 may alternatively be installed on a strap button 130 in a method where the strap lock mechanism 110 automatically latches onto the narrow middle portion of the strap button 130. The automatic method generally includes a user pushing the strap button through opening 123 and pushing the protrusion 117 upward, sliding the strap button 130 into the u-shaped slot 119, at which point the protrusion 117 automatically snaps downward locking the strap button 130 in place. To install the strap lock mechanism 110 using this method, a user first places the strap lock mechanism 110 over a strap button 130 so that the strap button is generally centered under the portion of the opening 123 furthest from the pivot plate 113. This portion of the opening 123 is wider than the diameter of the strap button 130 so that the strap button 130 can pass through the opening without interference from the strap end 111. The user then presses the strap lock mechanism 110 down onto the top of the strap button 130 so that the strap button 130 passes through the opening 123 and contacts the protrusion 117. The user then pushes downward on the strap lock mechanism 110 on any location except the top of the retaining lever 112 to cause the top of the strap button 130 to push the protrusion 117 up relative to the u-shaped opening 119. The force of the user pushing downward counteracts the force of the torsion spring 126 and causes the protrusion 117 to move upward in its arc. Once the protrusion is high enough to allow the narrow portion of the strap button 130 to slide into the u-shaped slot 119, the user then slides the strap lock mechanism 110 relative to the strap button 130 so that the strap button 130 enters the u-shaped slot 119. When the strap button 130 is fully seated in the u-shaped slot 119, it moves within the radius of the protrusion's 117 arc and is no longer in contact with the bottom of the protrusion 117. The protrusion 117, now without a strap button 130 under it, snaps downward until the bottom of the retaining lever 112 contacts the top of the strap button 130. At this point, the strap button 130 is securely locked in place and the strap lock mechanism 110 is in the locked position.

It is also possible to form the entire mechanism in one piece such that the spring function is accomplished using the flexibility of the material used. In FIGS. 10-14 is a second embodiment of the invention, a strap lock mechanism 210, constructed out of a single piece of material. The elements in the alternative embodiments which are substantially the same as the corresponding elements of the first embodiment described are identified with the same numeral. Elements which are similar (but not necessarily identical) in function are denoted by the same numeral plus 100.

Strap lock mechanism 210 is shown and described as being comprised of a single piece of material, however, it is possible to use multiple parts fixed together to achieve a similar structure. The second embodiment may be constructed out of plastic or any other material with enough flexibility to bend at the integral spring 241 while maintaining the overall shape of the retaining lever 242 and lower arm 243. The second embodiment may also be constructed out of other materials, including but not limited to, metal, fiber, resin, polymer or a combination of these and/or other materials.

In this embodiment, top or upward refers to the retaining lever 242 end of the locking strap mechanism 210 and bottom or downward refers to the lower arm 243 end of the mechanism 210. Front refers to the integral spring 241 end of the locking strap mechanism 210, rear refers to the elongated opening 240 end and side refers to a direction perpendicular to a line running from the integral spring 241 end to the elongated opening 240 end.

Figure 10:
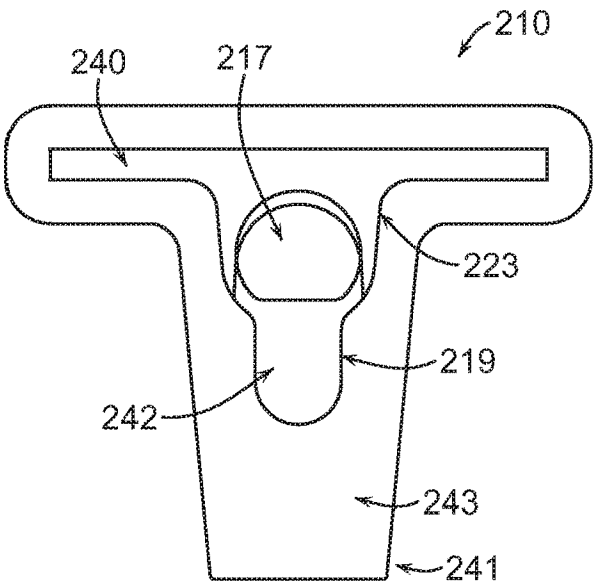
FIG. 10 is a bottom view of a second embodiment of the invention.

In FIG. 10 is a bottom view of the strap lock mechanism 210 showing the bottom of opening 223 and u-shaped slot 219. The retaining lever 242 and lower arm 243 are fixed to upper and lower ends, respectively, of an integral spring 241. The integral spring 241 provides an axis of rotation where one arm or lever is capable of rotating along a limited arc independently of the other arm or lever. The integral spring 241 also provides a force keeping the retaining lever 242 and lower arm 243 substantially parallel to each other. The integral spring 241 provides a downward force on the retaining lever 242 if deflected upward relative to the lower arm 243 and vice versa if deflected downward. The configuration of the retaining lever 242 and lower arm 243 as substantially parallel at rest is exemplary in nature and the angle between the arms can be adjusted within the inventive concept expressed herein.

The second embodiment of the strap lock mechanism 210 is designed to attach to a loop at the end of a strap rather than mount within or through a strap end. To provide a means of mounting the strap lock mechanism 210 to a strap, there is an elongated opening 240 at the rear of the device. The elongated opening 240 in this embodiment is configured to accept the end of a strap, either by looping the strap through the opening or by otherwise fixing the strap to an edge of the opening 240 using a fastener. While an elongated opening 240 is depicted as the means of attaching this embodiment to a strap, it is appreciated that this is merely one of many means of attaching the invention to a strap.

Similar to the first embodiment, the second embodiment of a strap lock mechanism 210 uses a downward extending protrusion 217 that is capable of being raised and lowered relative to a u-shaped slot 219. The protrusion 217 is fixed to the bottom of the retaining lever 242 at its distal end from the integral spring 241 end. The u-shaped slot 219 is a feature of the lower arm 243 and is a shorter distance from the integral spring 241 end of the lower arm 243 than the protrusion 217 is from the integral spring 241 end of the retaining lever 242. In the embodiment pictured, the opening 223 is open to the elongated opening 240, however this configuration is exemplary in nature and the two openings may also be separate from one another. The elongated opening 240 must only be wide enough to accomplish its intended purpose of providing a mounting point for a strap.

The opening 223 must be large enough to allow the wide end of a strap button to pass freely through it in the up and down directions.

Figure 12:
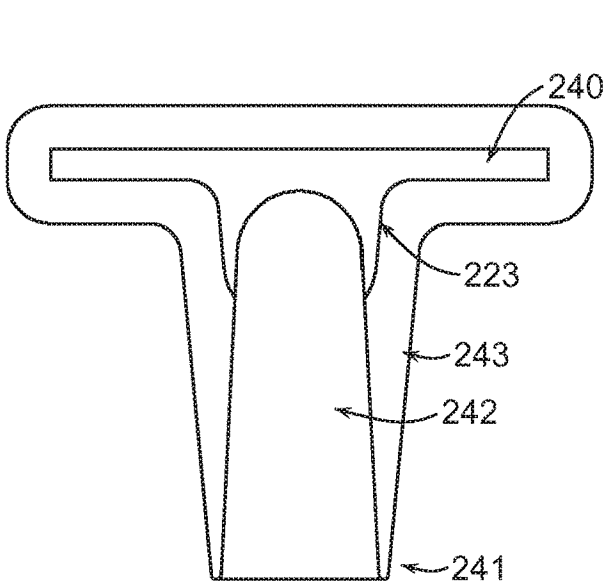
FIG. 12 is a top view of the second embodiment of the invention.
Figure 11:
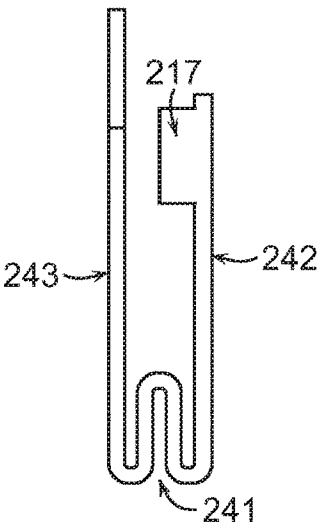
FIG. 11 is a side view of the second embodiment of the invention.

In FIG. 11 is a side view of the strap lock mechanism 210 showing the relative position of the retaining lever 242 and lower arm 243 without any force deflecting them closer or further apart. In FIG. 12 is a top view of the strap lock mechanism 210 showing the configuration of the components from an alternative view.

Figure 13:
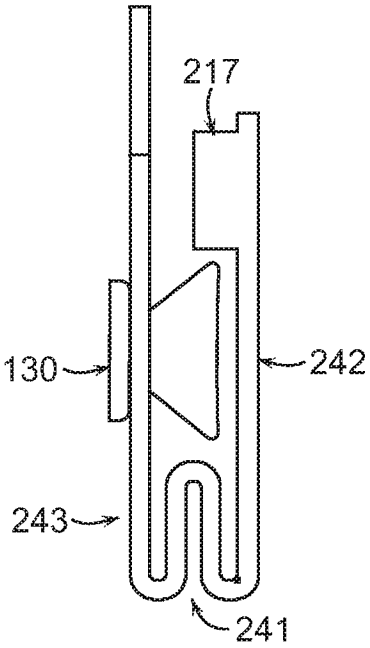
FIG. 13 is a side view of the second embodiment of the invention shown in the locked position over a strap button.

In FIG. 13 is a side view of the strap lock mechanism 210 in the locked position over a strap button 130. When the strap lock mechanism 210 is in the locked position, the wide upper portion of the strap button is held in a void between the bottom of the retaining lever 242 and the top of the u-shaped slot 219 in the up and down direction, the sides of the u-shaped slot in the side to side and forward directions and the side of the protrusion 217 in the rearward direction. When in the locked position, the strap button 130 is still capable of a limited amount of motion relative to the strap lock mechanism 210 and is free to rotate relative to the strap lock mechanism 210. The u-shaped slot 219 is narrower than the width of the top of the strap button 130, preventing it from being pulled downward. When the retaining lever 242 and lower arm 243 are held at their equilibrium position by the integral spring 241, the distance between the bottom of the protrusion 217 and a plane defined by the upper surface of the lower arm 243 is less than the height of the strap button 130 that extends above upper surface of the lower arm 243.

The strap button 130 can be released by lifting the protrusion 217 relative to the lower arm 243, giving the strap button 130 adequate space to slide out of the u-shaped slot 219 and then through the opening 223. Lifting the protrusion 217 relative to the lower arm 243 also provides a method of installing the strap lock mechanism 210 on a strap button 130. With the protrusion 217 lifted, the strap button 130 can be inserted through the opening 223 and slid into the u-shaped slot 219, engaging the slot with the narrow portion of the strap button 130.

The locking strap mechanism 210 may also be installed in a method where the strap lock mechanism 210 automatically latches onto the narrow middle portion of the strap button 130. A user starts by inserting the top of a strap button 130 into opening 223 so that the top of the strap button contacts the bottom of the protrusion 217. A user then pushes down on any location on the locking strap mechanism 210 other than the retaining lever 242. The downward force causes the protrusion 217 to move upward relative to the lower arm 243. Once the protrusion 217 is high enough relative to the lower arm 243 to allow the strap button 130 to enter the u-shaped slot 219, the user then slides the device relative to the strap button 130 so that the u-shaped slot 219 engages the narrow portion of the strap button 130. When the strap button 130 is fully seated in the u-shaped slot 219, it moves within the radius of the protrusion's 217 arc of motion and is no longer in contact with the bottom of the protrusion 217. The protrusion 217, now without a strap button 130 under it, snaps downward until the integral spring 241 brings the retaining lever 242 and the lower arm 243 into their equilibrium position relative to each other. At this point, the strap button 130 is securely locked in place and the strap lock mechanism 210 is in the locked position.

Figure 14:
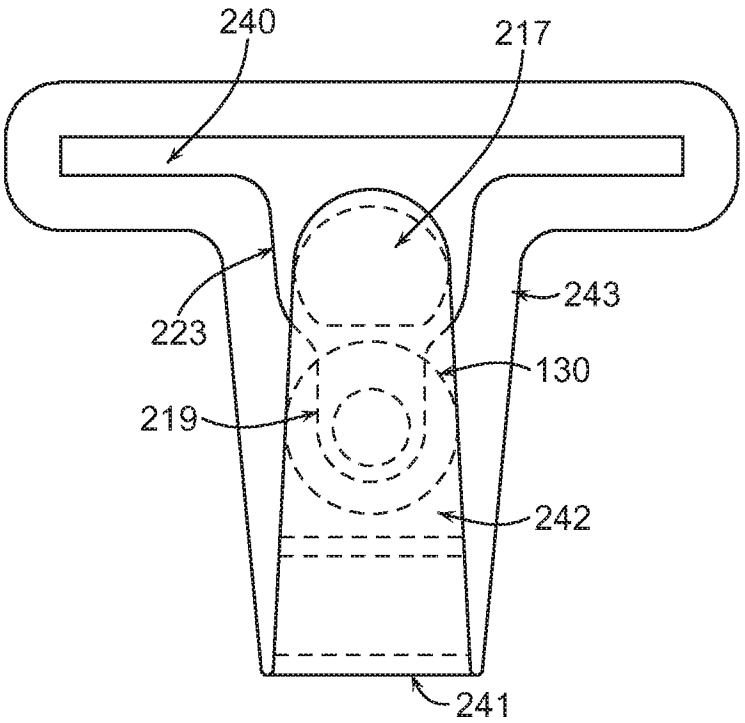
FIG. 14 is a top view of the second embodiment of the invention shown in the locked position over a strap button where hidden features are shown in dashed lines.

In FIG. 14 is a top view showing the strap lock mechanism 210 in the locked position over a strap button 130. In this view, hidden features are shown in dashed lines. From the top view, the relationship between the size of the strap button 130, u-shaped slot 219 and opening 223 are apparent. The strap button 130 is wider at its top than the width of the u-shaped slot 219. The strap button 130 is narrower at its top that than the width of opening 223.

Figure 15:
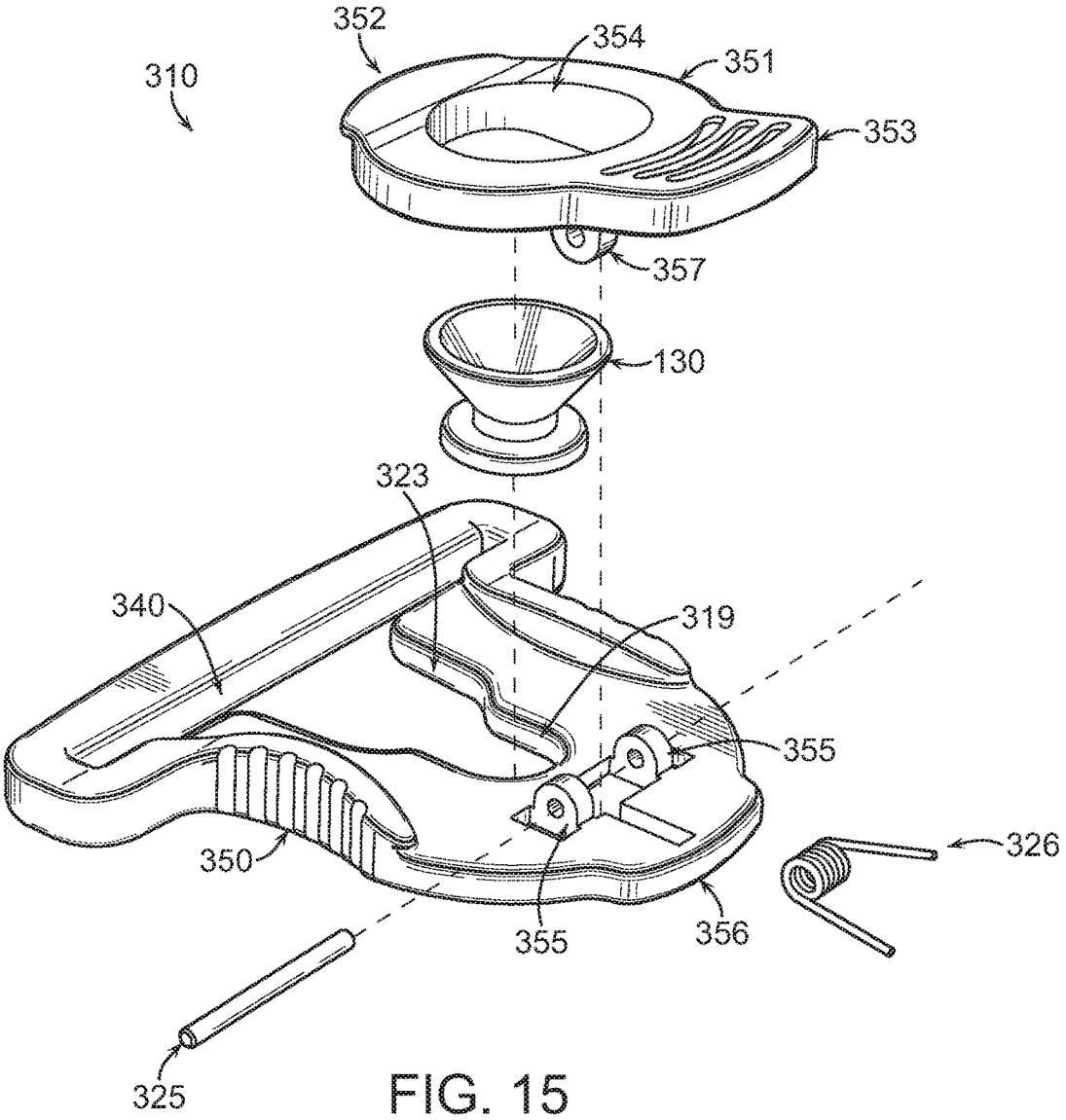
FIG. 15 is an exploded isometric view of a third embodiment of the invention.
Figure 17:
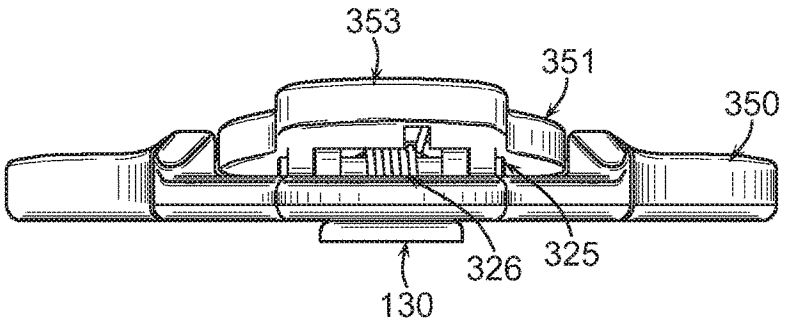
FIG. 17 is a rear view of a third embodiment of the invention shown in the locked position over a strap button.
Figure 16:
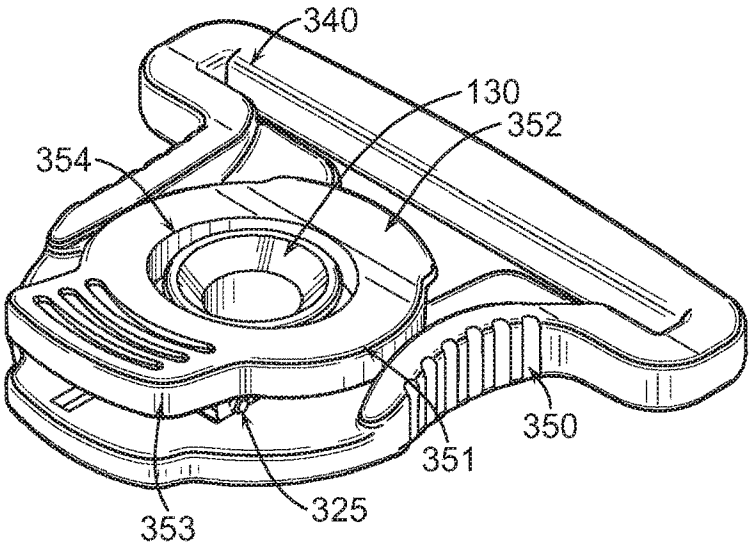
FIG. 16 is an isometric view of a third embodiment of the invention shown in the locked position over a strap button.
Figure 18:
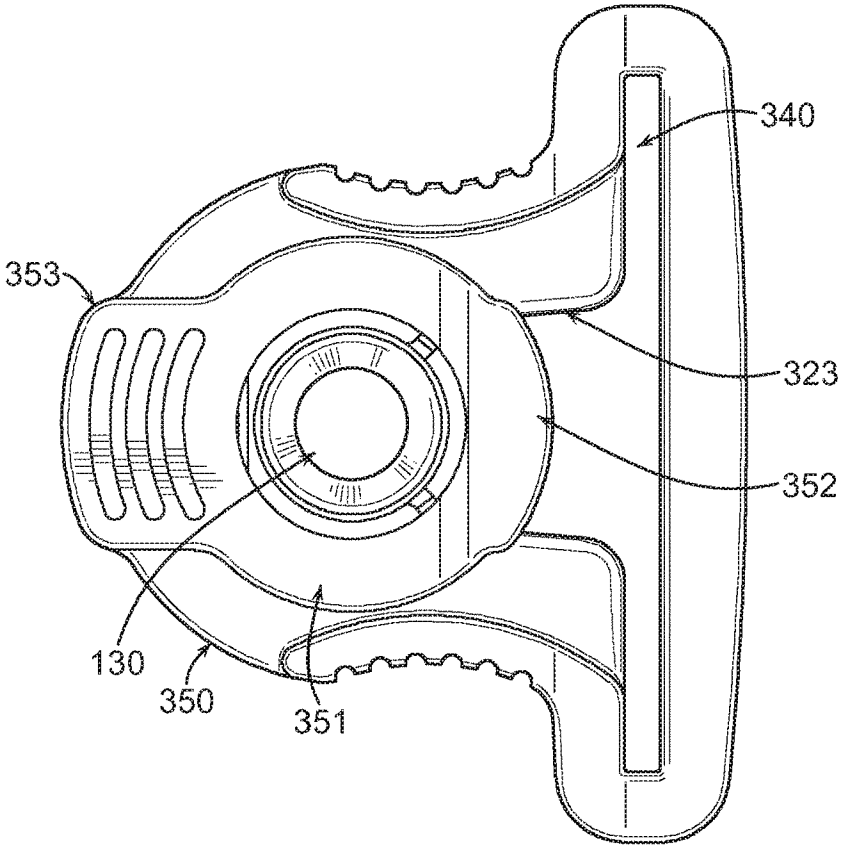
FIG. 18 is a top view of the third embodiment of the invention shown in the locked position over a strap button.
Figure 19:
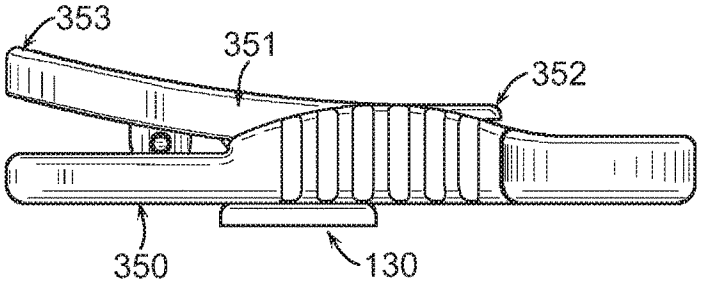
FIG. 19 is a side view of the third embodiment of the invention shown in the locked position over a strap button.

In FIGS. 15-21 is a third embodiment of the invention, a locking strap mechanism 310. In FIG. 15 is an isometric exploded view of the locking strap mechanism 310, showing the components comprising the device. The locking strap mechanism 310 is comprised of a lower arm 350 rotatably coupled to a retaining lever 351 about a pin 325. The lower arm 350 has upward facing tabs 355 located near a first end 356 and the retaining lever 351 has downward facing tabs 357 located near a first end 353. The upward facing tabs 355 and downward facing tabs 357 are rotatably coupled to the pin 325, providing an axis of rotation between the retaining lever 351 and the lower arm 350 along the longitudinal axis of the pin 325. Situated about the pin 325 is a torsion spring 326 that pushes the distal end 352 of the retaining lever 351 downward relative to the lower arm 350.

In this embodiment, top or upward refers to the retaining lever 351 end of the locking strap mechanism 310 and bottom or downward refers to the lower arm 350 end of the mechanism 310. Front refers to the direction of the first end 353 of the locking strap mechanism 310, rear refers to the direction of the elongated opening 340 and side refers to a direction perpendicular to a line running from the first end 353 to the elongated opening 340 end.

The third embodiment of the locking strap mechanism 310 is designed to be attached to the end of strap, either by looping the strap through the elongated opening 340 or fastening the strap to the opening. The lower arm 350 is further comprised of an opening 323 that is wider than the diameter of the top of the strap button 130 and a u-shaped slot 319 that is narrower than the diameter of the top of the strap button 130. The u-shaped slot 319 is wider than the narrow middle of the strap button 130, allowing the edge of the u-shape slot 319 to engage the sides of the narrow middle of the strap button 130. In use, the top of the strap button 130 passes up through opening 323 and the u-shaped slot 319 engages the narrow portion of the strap button 130. The retaining lever 351 is further comprised of a substantially circular opening 354 that is larger in diameter than the diameter of the top of the strap button 130. The retaining lever 351 also has a first end 353 on the end closest to the pin 325 and a distal end 352 on the end furthest from the pin 325.

In FIGS. 16-19 are various views of the third embodiment of the locking strap mechanism 310 shown in the locked position over a strap button 130. When in the locked position, the distal end 352 of the retaining lever 351 is at the lowest position in its arc of motion relative to the lower arm 350. The strap button is locked in place in the downward direction by the top of the u-shaped slot 319, the upward direction by the bottom of the u-shaped slot, the side to side and forward directions by the sides of the u-shaped slot 319 and the rearward direction by the inside edge of the circular opening 354. The strap button may alternatively by locked in place in the side to side and forward directions by the inside edge of the circular opening 354.

Figure 20:
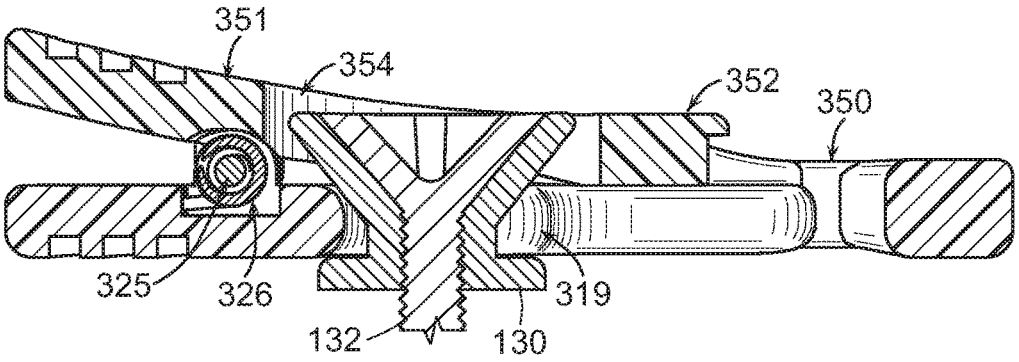
FIG. 20 is a side sectioned view of the third embodiment of the invention shown in the locked position over a strap button.
Figure 21:
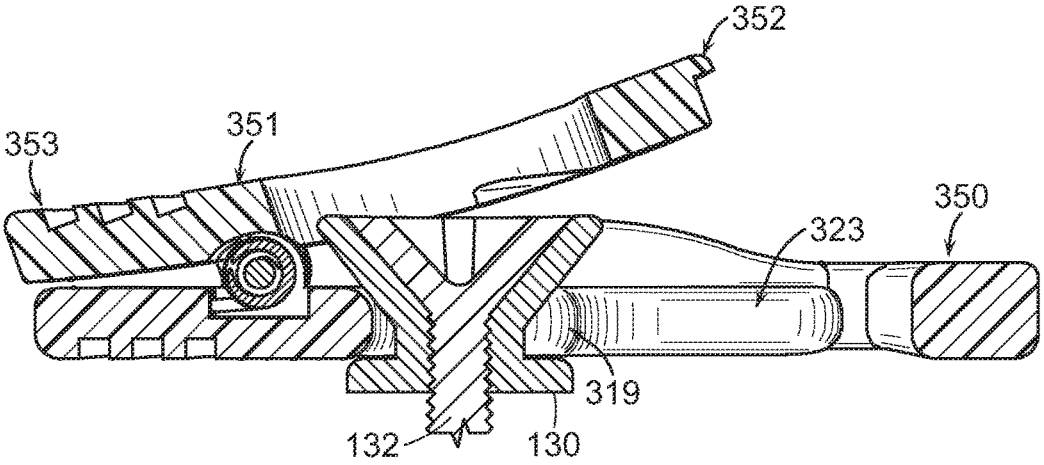
FIG. 21 is a side sectioned view of the third embodiment of the invention shown in the open position over a strap button.
Figure 22:
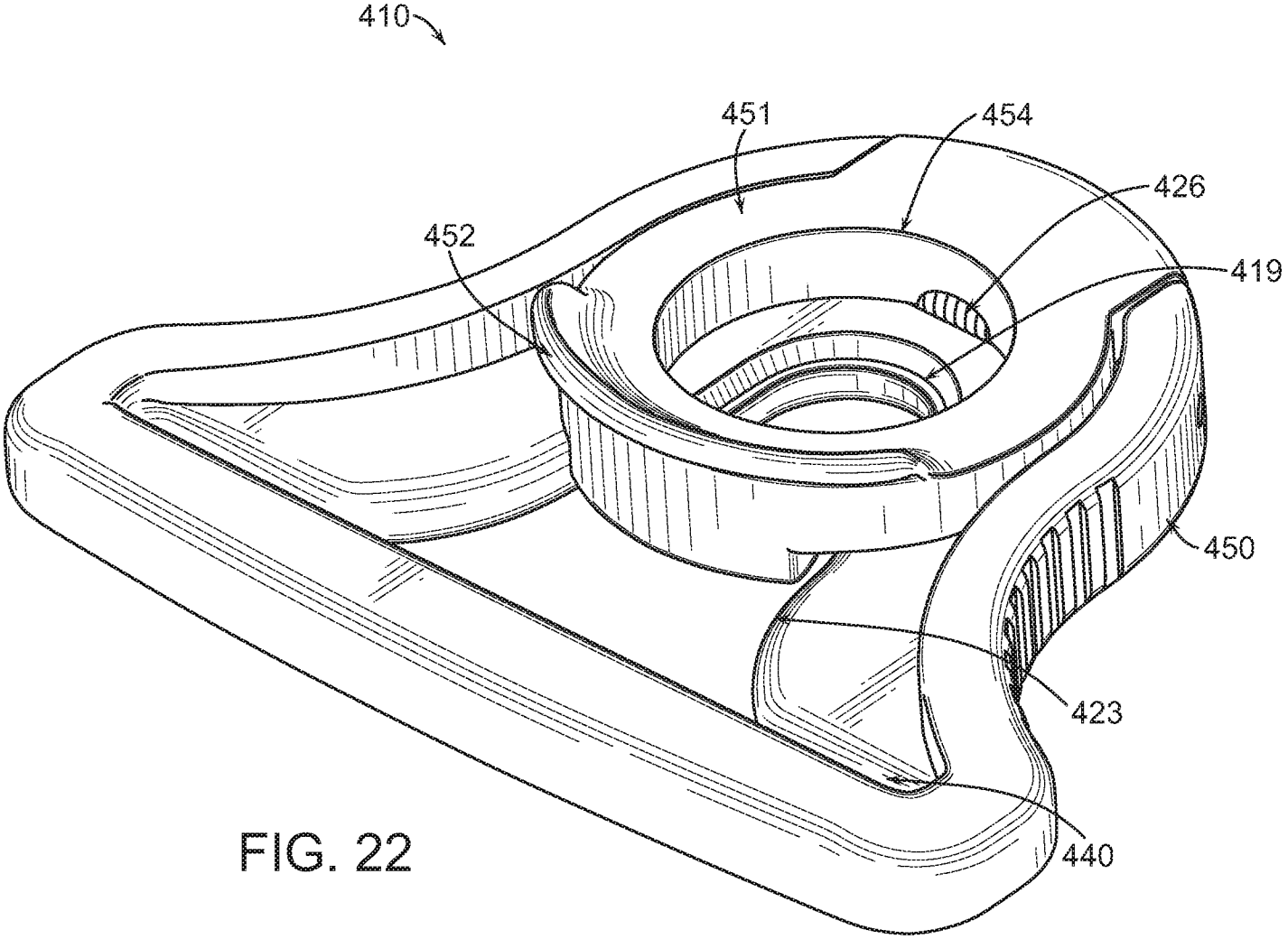
FIG. 22 is an isometric view of a fourth embodiment of the invention shown in the closed position.
Figure 23:
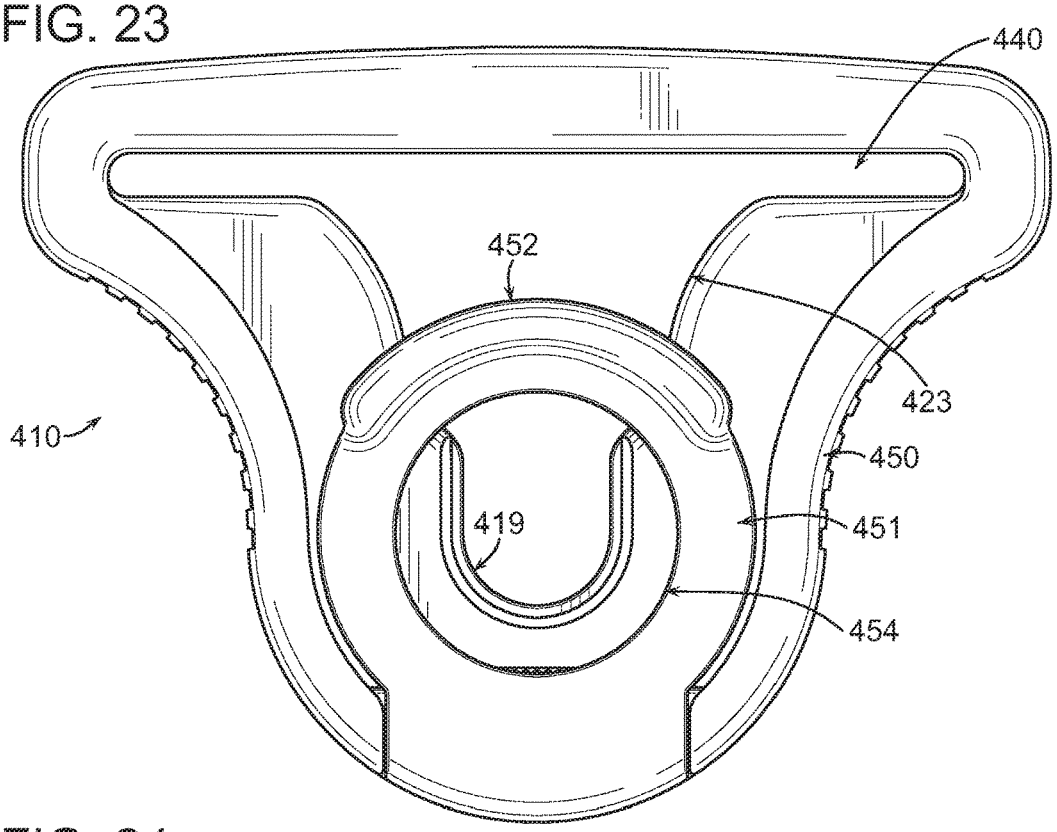
FIG. 23 is a top view of a fourth embodiment of the invention shown in the closed position.
Figure 24:
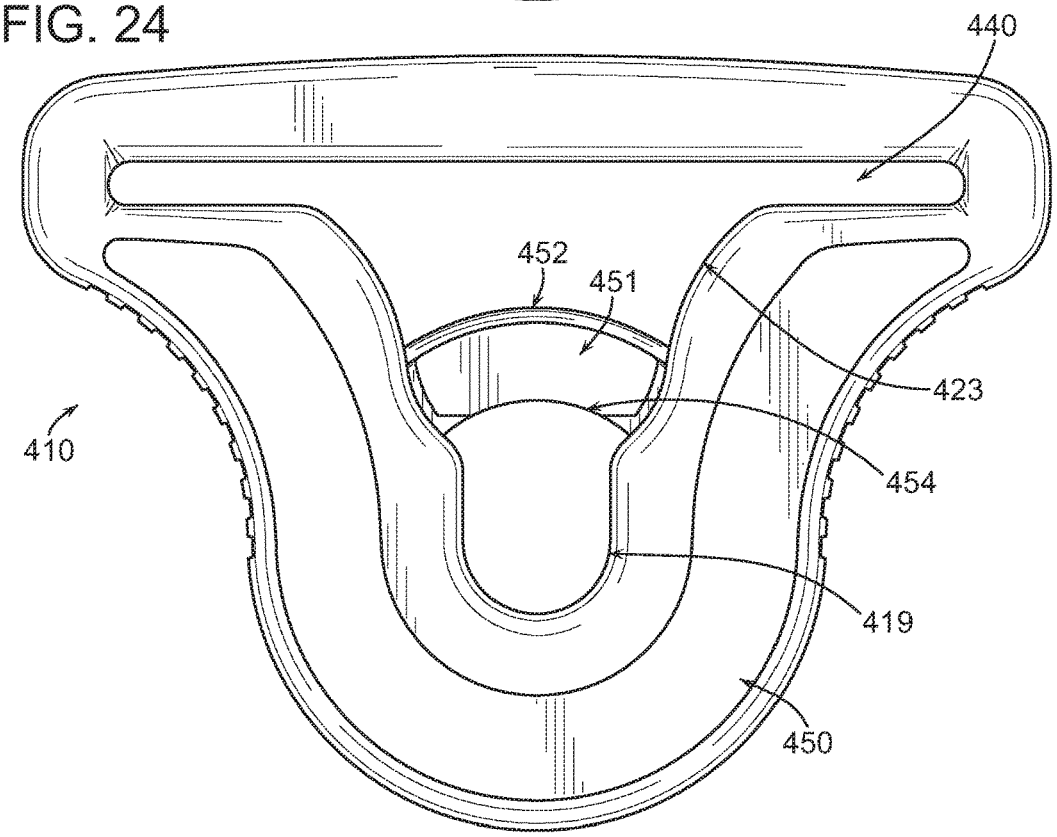
FIG. 24 is a bottom view of a fourth embodiment of the invention shown in the closed position.
Figure 25:
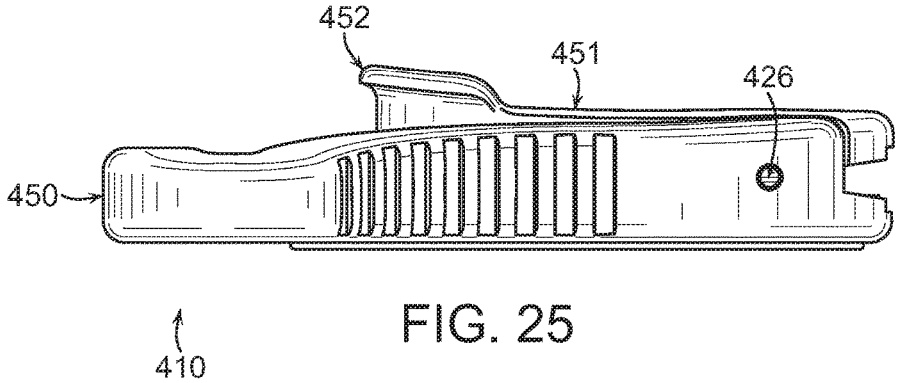
FIG. 25 is a side view of a fourth embodiment of the invention shown in the closed position.
Figure 26:
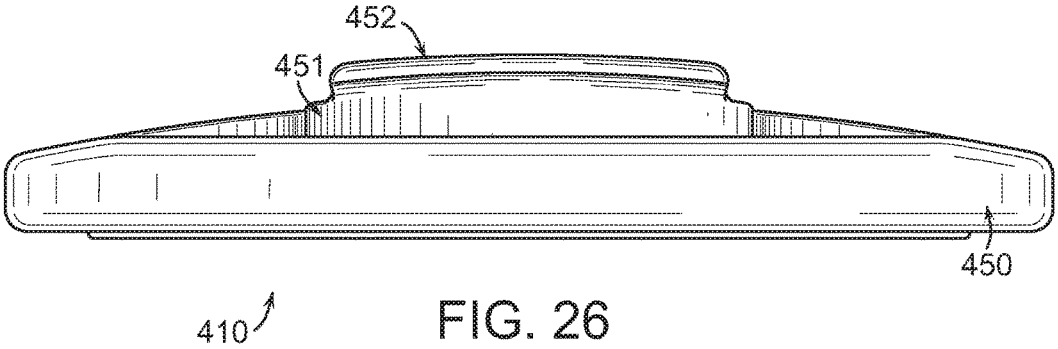
FIG. 26 is a front view of a fourth embodiment of the invention shown in the closed position.
Figure 27:
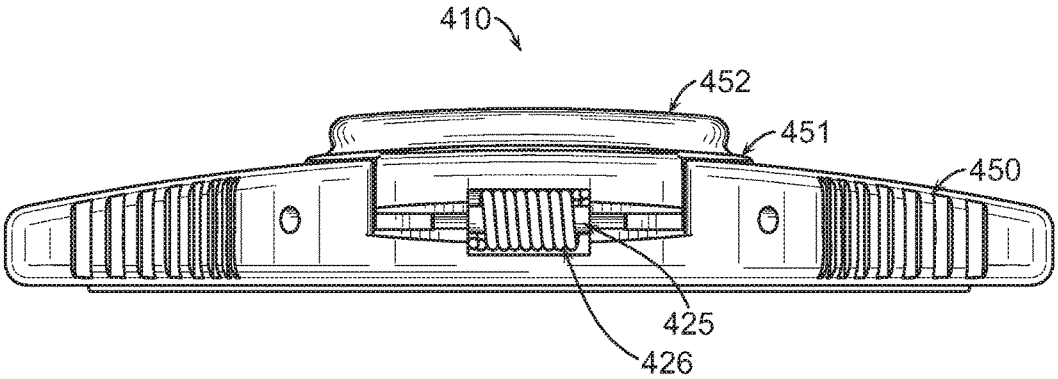
FIG. 27 is a rear view of a fourth embodiment of the invention shown in the closed position.

In FIGS. 20-21 are side sectioned views of the third embodiment of the strap lock mechanism 310, sectioned through a vertical plane oriented along the front to rear axis and centered on the device from side to side. Only one side of the locking strap mechanism 310 is shown because the opposite side is a mirror image. In FIG. 20, the strap lock mechanism 310 is in the locked position over a strap button 130 that is secured to an instrument with a screw 132. In the locked position, the strap button 130 is not free to move out of the void defined by the circular opening 354 in the retaining lever 351 and the u-shaped slot 319 of the lower arm 350. The u-shaped slot 319 engages the narrow middle portion of the strap button 130 and prevents the strap button 130 from being pulled downward through the u-shaped slot 319. The circular opening 354 prevents the strap button 130 from sliding out of the u-shaped opening 319, effectively locking it in place relative to the strap lock mechanism 310. When in the locked position, the strap button 130 is still capable of a limited amount of motion relative to the strap lock mechanism 310 and is free to rotate relative to the strap lock mechanism 310.

In FIG. 21, the strap lock mechanism 310 is in the open position over a strap button 130. In the open position, the distal end 352 of the retaining lever 351 is lifted to allow the strap button 130 to freely move in or out of the u-shaped slot 319. The distal end 352 can be lifted relative to the lever arm 350 by lifting on the distal end 352 or pressing down on the first end 353.

When installing the strap lock mechanism 310 on a strap button, a user can alternatively use a method where the strap lock mechanism 310 automatically latches onto the narrow middle portion of the strap button 130. A user starts by placing the opening 323 over the strap button 130 so that the top of the strap button 130 contacts the bottom of the distal end 352. The user then pushes down on any portion of the strap lock mechanism 310 other than the retaining lever 351 to cause the distal end 352 to move upward relative to the lower arm 350. Once the distal end 352 is raised high enough to allow the strap button 130 to slide into the u-shaped slot 319, the user then slides the strap lock mechanism 310 to engage the u-shaped slot 319 against the narrow portion of the strap button 130. Once fully seated in the u-shaped slot 319, the strap button 130 is fully below the circular opening 354. The distal end 352, now without a strap button 130 under it, snaps down due to the force generated by the torsion spring 326. At this point, the strap button 130 is securely locked in place and the strap lock mechanism 310 is in the locked position.

In FIGS. 22-27 is a fourth embodiment of the strap lock mechanism 410. The locking strap mechanism 410 is comprised of a lower arm 450 rotatably coupled to a retaining lever 451 about pin 425. Situated about the pin 425 is a torsion spring 426 that pushes the distal end 452 of the upper arm 451 downward relative to the lower arm 450 in an arc centered on the longitudinal axis of the pin 425.

In this embodiment, top or upward refers to the retaining lever 451 end of the locking strap mechanism 410 and bottom or downward refers to the lower arm 450 end of the mechanism 410. Front refers to the direction of the first end 453 of the locking strap mechanism 410, rear refers to the direction of the elongated opening 440 and side refers to a direction perpendicular to a line running from the first end 453 to the elongated opening 440 end.

The fourth embodiment of the locking strap mechanism 410 is designed to be attached to the end of strap, either by looping the strap through the elongated opening 440 or fastening the strap to the opening 440. The retaining lever 451 is further comprised of a substantially circular opening 454 that is larger in diameter than the diameter of the top of the strap button 130. The lower arm 450 is further comprised of a u-shaped slot 419 and opening 423. The u-shaped slot 419 is narrower than the diameter of the top of the strap button 130 and wider than the narrow portion of the strap button 130. The opening 423 is wider than the diameter of the top of the strap button 130, allowing the strap button to pass through the opening 423. In use, the top of the strap button 130 is capable of passing up through the opening 423 and sliding into the u-shaped slot 419.

The fourth embodiment of the locking strap mechanism 410 functions similarly to the third embodiment of the locking strap mechanism 310. The locking strap mechanism 410 is shown in the closed position in FIGS. 22-27. The torsion spring 426 causes the distal end 452 of the retaining lever 451 to move downward relative to the lower arm 450, making the closed or locked position this embodiment's equilibrium position. When in the locked position, the strap button 130 is still capable of a limited amount of motion relative to the strap lock mechanism 410 and is free to rotate relative to the strap lock mechanism 410. To move the locking strap mechanism 410 into the open position, a user would lift on the distal end 452 of the retaining lever 451, raising the distal end 452 in an arc relative to the lower arm 450. Once the distal end 452 is high enough to allow a strap button 130 to freely move in or out of the u-shaped slot 419, the strap lock mechanism 410 is in the open position.

When installing the strap lock mechanism 410 on a strap button, a user can alternatively use a method where the strap lock mechanism 410 automatically latches onto the narrow middle portion of the strap button 130. A user starts by placing the opening 423 over the strap button 130 so that the top of the strap button 130 contacts the bottom of the distal end 452. The user then pushes down on any location on the strap lock mechanism 410 other than the retaining lever 451 to cause the distal end 452 to move upward relative to the lower arm 450. Once the distal end 452 is raised high enough to allow the strap button 130 to slide into the u-shaped slot 419, the user then slides the strap lock mechanism 410 to engage the u-shaped slot 419 against the narrow middle portion of the strap button 130. Once fully seated in the u-shaped slot 419, the strap button 130 is fully below the circular opening 454 and the distal end 452 snaps down due to the force generated by the torsion spring 426. At this point, the strap button 130 is securely locked in place and the strap lock mechanism 410 is in the locked position.

Figure 28:
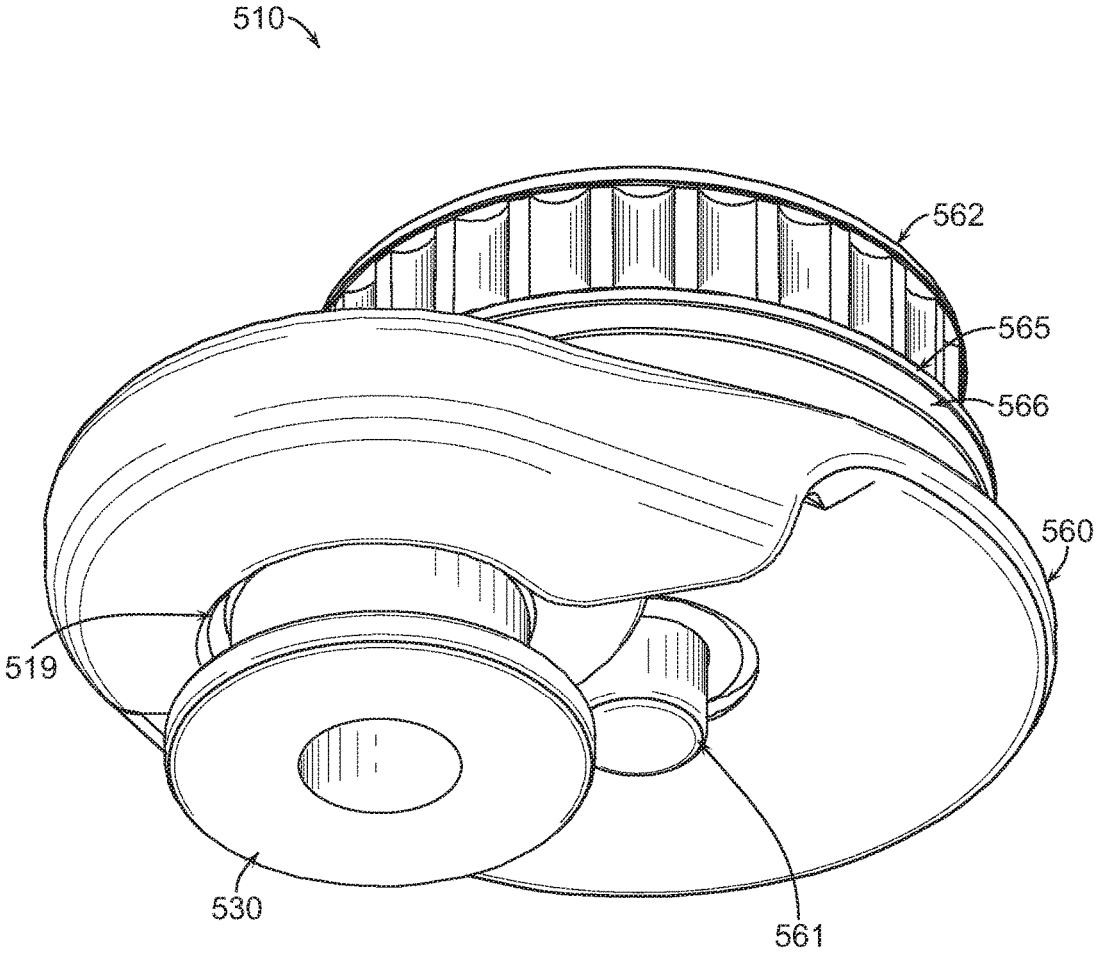
FIG. 28 is an isometric view of a fifth embodiment of the invention shown in the locked position over a strap button.

In FIGS. 28-34 is a fifth embodiment of the strap lock mechanism 510. In FIG. 28 is an isometric view of the strap lock mechanism 510 shown in the locked position over a strap button 530. The strap lock mechanism 510 is comprised of a body 560 with a u-shaped slot 519 on its bottom to engage a strap button 530 and a spring-loaded downward-facing retaining pin 561. The retaining pin 561 is configured to slide in its axial direction relative to the body 560 over a certain range of motion. The retainer pin 561 is fixed to a spring loaded lifting mechanism that pushes the retainer pin 561 downward at its equilibrium position and provides the user a method of lifting the retainer pin 561 relative to the body 560.

In this embodiment, top or upward refers to the knob 562 end of the locking strap mechanism 510 and bottom or downward refers to the u-shaped slot 519 end of the mechanism 510. Front refers to the direction that the open end of the u-shaped slot 519 faces, rear refers to direction opposite of front and sides refer to a direction perpendicular to a vertical plane running through the center of the u-shaped slot 519.

The u-shaped slot 519 of the body 560 is narrower than the wide top of a strap button 530 and wider than the narrow middle portion of the strap button. The u-shaped slot 519 is open on the end closest to the retainer pin 561, providing a path for the strap button 530 to enter and exit the slot. When the retainer pin 561 is at the lower limit of its range of motion, the strap lock mechanism 510 is in its locked or closed position. When the locking pin 561 is raised at or near the upper limit of its range of motion, the strap lock mechanism 510 is in its open position.

The fifth embodiment of the strap lock mechanism 510 is adapted to fit over strap button 530 to provide a secure fit. In this exemplary embodiment, strap button 530 is sized to fit in the u-shaped slot 519 without excessive space between the narrow middle portion of the strap button 530 and the sides of the u-shaped slot 519. The strap lock mechanism 510 may optionally be designed to fit over a generic strap button, but due to the wide variations in strap button shapes, the u-shaped slot 519 would need to be sized wide enough to accommodate the wider generic strap buttons on the market. If the strap lock mechanism 510 were designed to fit a range of generic strap buttons, the fitment of a narrower generic strap button could result in unwanted rattling due to the excessive space between the u-shaped slot 519 and generic strap button.

Figure 29:
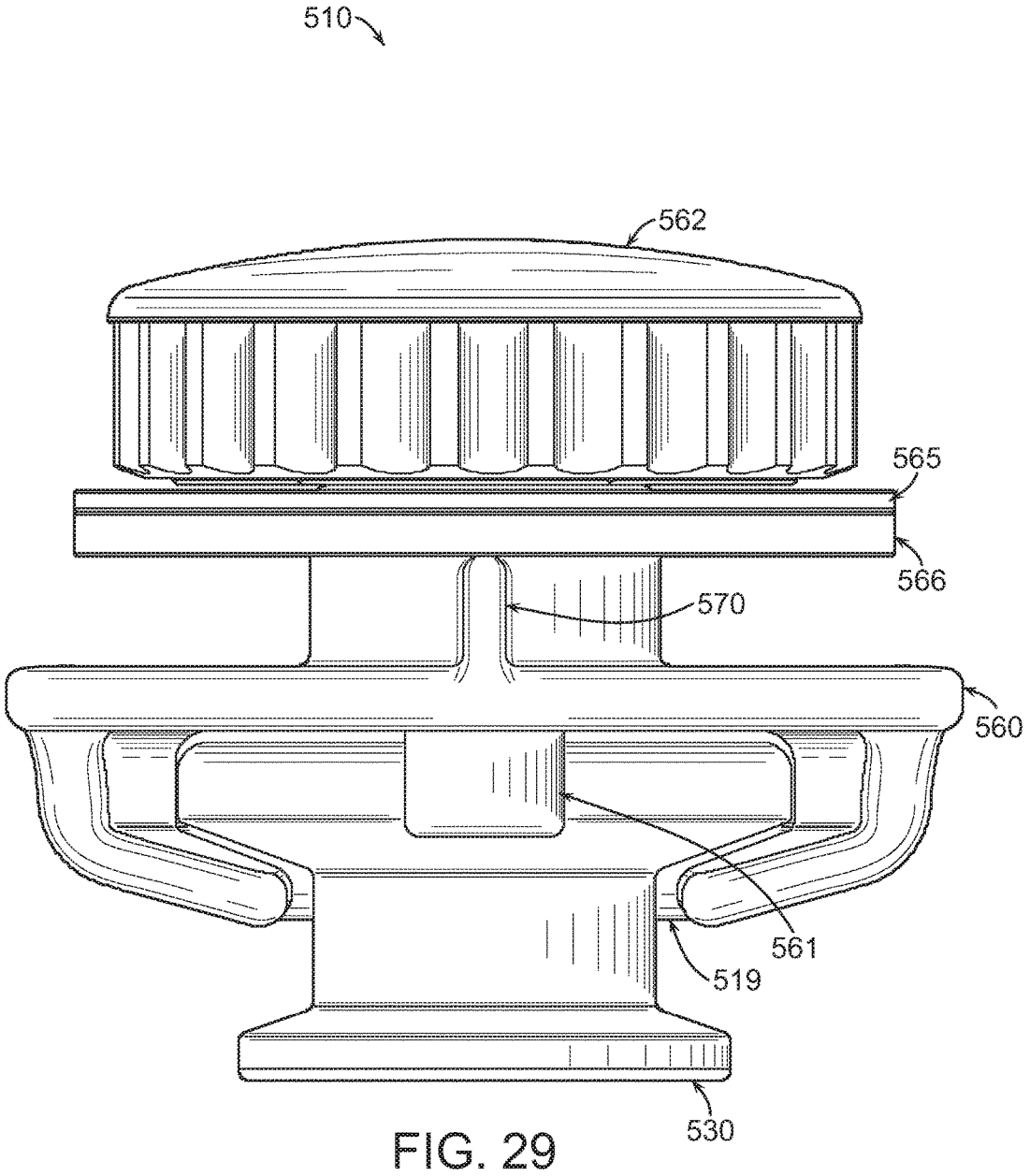
FIG. 29 is a front view of a fifth embodiment of the invention shown in the locked position over a strap button.

In FIG. 29 is a front view of the fifth embodiment of the strap lock mechanism 510 attached to a strap button 530. The locking pin 561 is attached, towards its upper end, to the bottom of a knob 562. Below the knob 562 are an optional first washer 565 and an optional second washer 566. The strap lock mechanism 510 mounts to the end of a strap so that the strap end is pinched between the top of the body 560 and the bottom of the second washer 566. If the first washer 565 and/or second washer 566 are omitted, the strap end would be pinched between fastener 564 (visible in FIGS. 32-34) and the body 560. Many strap ends have a substantially circular hole with a connected slit cut in the radial direction. A vertical fin 570 is located at the top of the body 560 to engage the radial slit cut away from the circular opening found on many strap ends.

Figure 30:
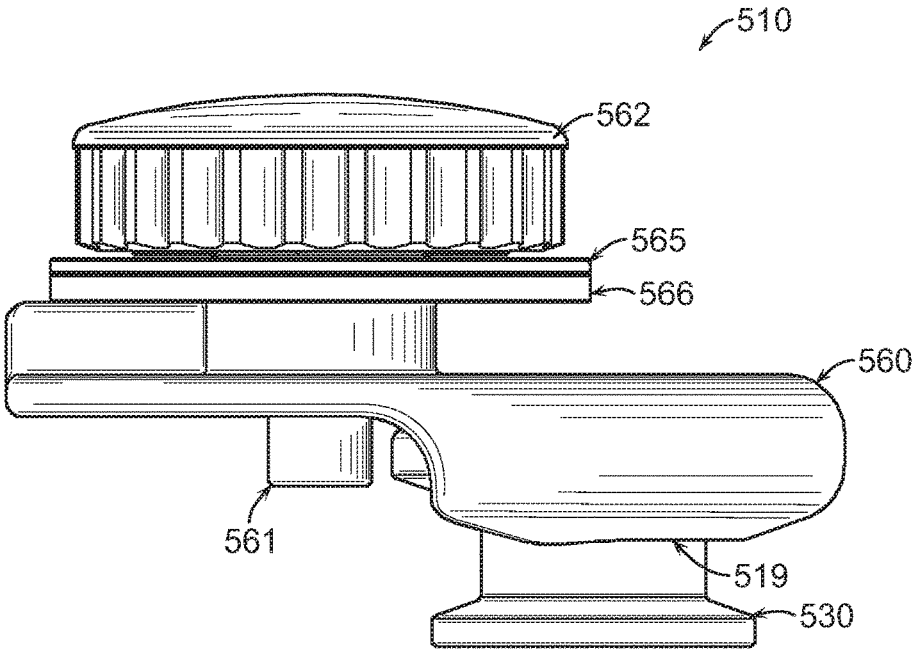
FIG. 30 is a side view of a fifth embodiment of the invention shown in the locked position over a strap button.

In FIG. 30 is a side view of the fifth embodiment of the strap lock mechanism 510 attached to a strap button 530. The strap button 530 is engaged by the u-shaped slot 519 on three sides and blocked from sliding out of the u-shaped slot 519 by the retainer pin 561. In one example, the retainer pin 561 must extend below the top edge of the strap button 530 to lock the strap button 530 in place. In another example, the retainer pin 561 must be retracted to above the top edge of the strap button 530 to place the strap lock mechanism 510 in the open position.

Figure 31:
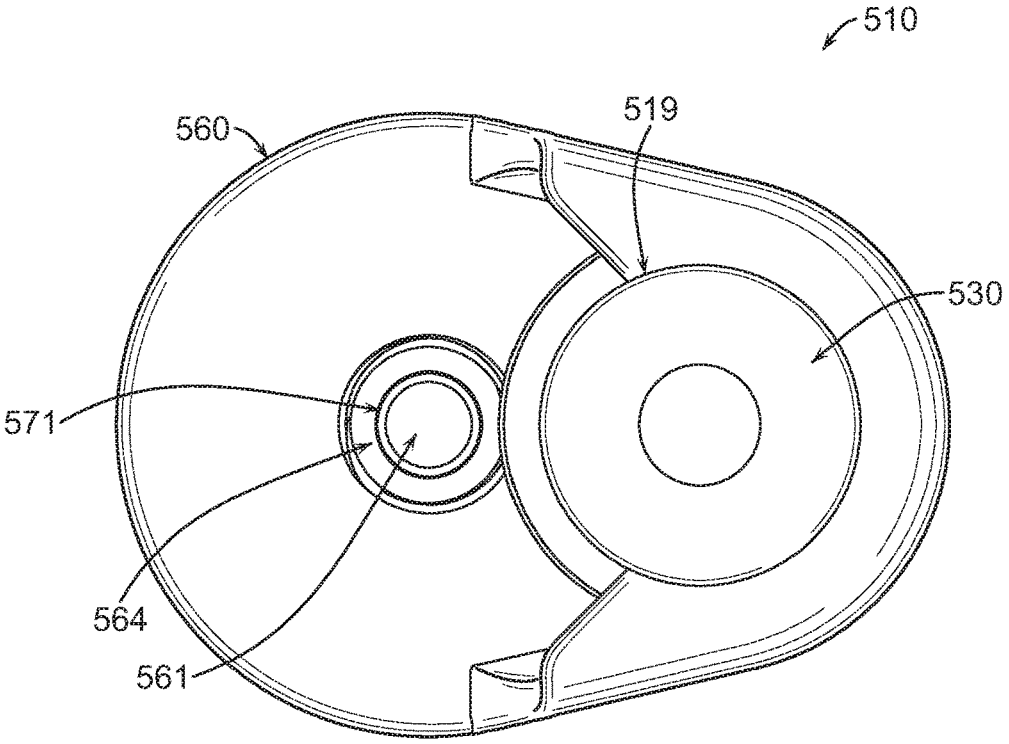
FIG. 31 is a bottom view of a fifth embodiment of the invention shown in the locked position over a strap button.

In FIG. 31 is a bottom view of the fifth embodiment of the strap lock mechanism 510 attached to a strap button 530. The width of the top of the strap button 530 compared to the width of the u-shaped slot 519 is apparent from this view. The interference between the wide top of strap button 530 with the top or sides of the u-shaped slot 519 prevents the strap button 530 from being pulled downward when locked in the slot. Also visible from the bottom is fastener 564, which attaches the locking strap mechanism 510 to a strap end. The fastener 564 pinches a strap end between the fastener's head and the top of the body 560. The fastener 564 is further comprised of a cylindrical stepped bore hole 571 that shares a longitudinal axis with the threaded portion of the fastener 564.

Figure 32:
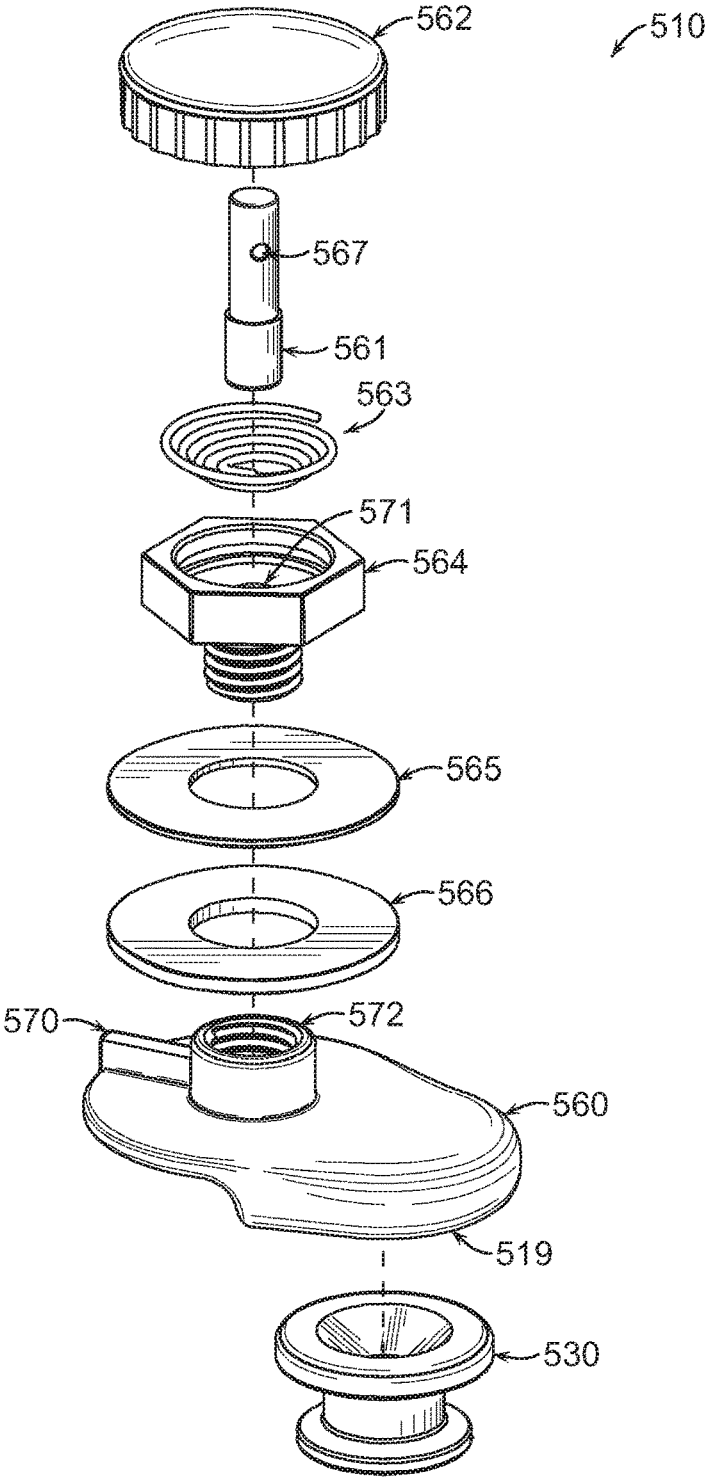
FIG. 32 is an exploded isometric view of a fifth embodiment of the invention.

In FIG. 32 is an exploded isometric view of the fifth embodiment of the strap lock mechanism 510 shown hovering over a strap button 530. The body 560 is comprised of an upper surface and bottom surface. A u-shaped slot 519 is fixed to the bottom surface and a threaded opening 572 passes through and extends upward from the upper surface. The threaded opening 572 is located forward of the u-shaped slot 519 and a fin 570 is fixed to the upper surface rearward from the threaded opening 572. When attaching the strap lock mechanism 510 to a strap, the circular opening of the strap end is placed over the threaded opening 572 and the connected radial slit of the strap is placed over the fin 570. The fastener 564 is then threaded into the threaded opening 572, pinching the strap between the head of fastener 564 and the top of the body 560. The first washer 565 and second washer 566 may be used if the strap material is thinner than the height of the threaded opening 572 above the top of the body 560. The optional second washer 566 and optional first washer 565, if used, may be placed over the threaded opening 572 prior to installing the fastener 564. The height of the threaded opening 572 above the top of the body 560 may optionally be reduced in height to accommodate thinner straps.

The retainer pin 561 slides inside the hole 571 through the center of the fastener 564. The fastener 564 is further comprised of a hex head that engages a corresponding internal hex shape 573 at the bottom of the knob 562. The internal hex shape 573 is visible in FIG. 34 and is spaced an adequate distance in the radial direction from the hex head of the fastener 564 so that the knob 562 can pull the retainer pin 561 up and return down automatically, but when the knob 562 is rotated it will turn the fastener 564.

A spiral spring 563 is attached to the retainer pin 561 and configured to push the retainer pin 561 down to retain the strap button 530. On one end of the spiral spring 563, the end of the spring wire is inserted into the hole 567 in the retainer pin 561. The other end of the spiral spring 563 is fixed to the fastener 564. The fastener 564 is further comprised of a counterbored portion at the top of its head with a small concentric groove cut near the bottom of the counterbored portion. The spiral spring 563 is inserted into the counterbored portion. The maximum diameter of the spiral spring 563 is slightly larger than the diameter of the counterbored portion so that the spiral spring 563 snaps into the concentric groove to retain the spring.

To provide a motion limiting stop in the upward direction, the retainer pin 561 has an upper portion with a narrower diameter than the lower portion. The hole 571 in the center of the fastener 564 is a stepped bore so that the upper portion has a narrower diameter than the lower portion, the diameters of the hole 571 corresponding with the retainer pin 561 to allow axial movement without excessive slop. When the retainer pin 561 is raised, the top of the larger diameter portion of the retainer pin 561 eventually contacts the bottom of the smaller diameter portion of the hole 571, providing a mechanical stop for the retainer pin 561 in the upward direction (visible in the side sectioned views of FIGS. 33 & 34).

Above the fastener 564, a knob 562 is fixed to the retainer pin 561. Between the knob 562 and the top of the counterbored portion of the fastener 564 is the spiral spring 563, pushing the retainer pin 561 downward. The retainer pin 561 can be pushed downward until the bottom of the knob 562 contacts the top of the fastener 564. Because the spring 563 pushes the retainer pin 561 downward, its equilibrium position is at its downward limit.

Figure 33:
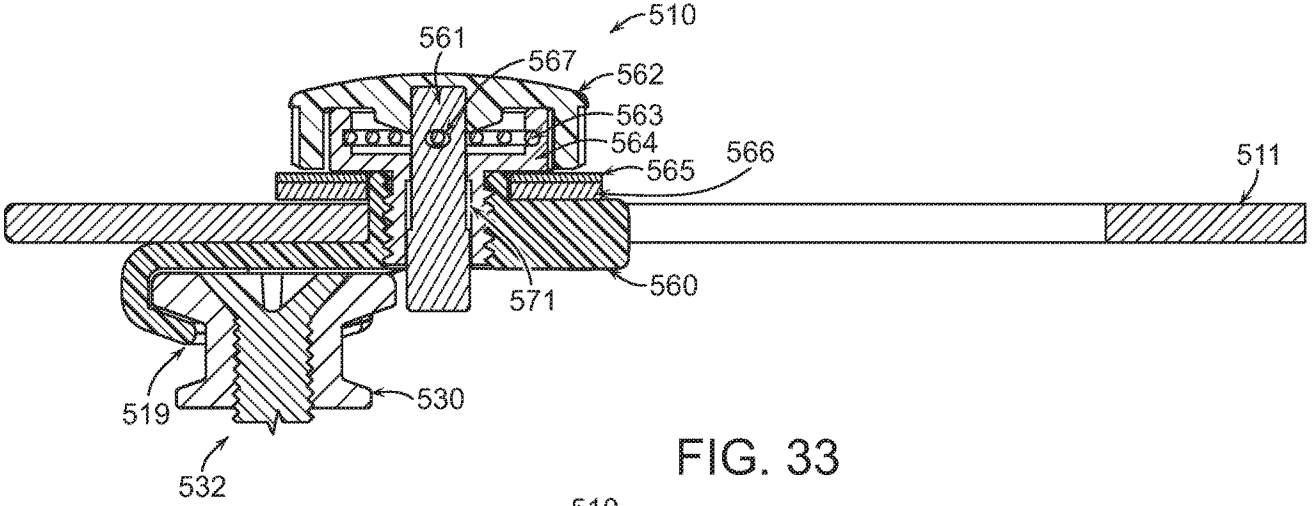
FIG. 33 is a side sectioned view of a fifth embodiment of the invention shown in the locked position over a strap button.
Figure 34:
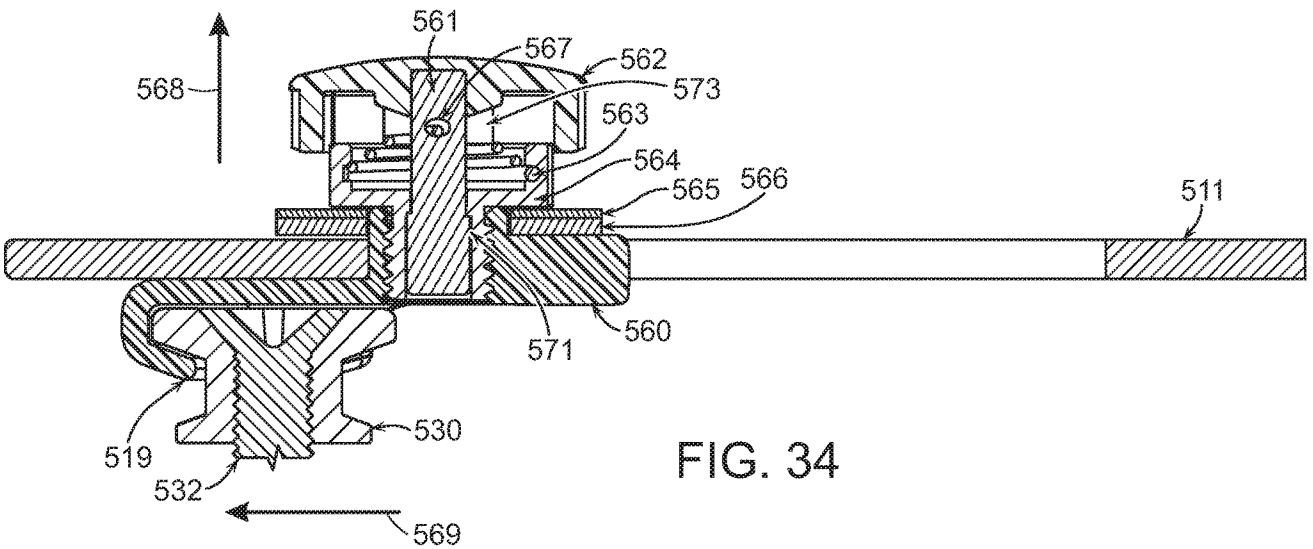
FIG. 34 is a side sectioned view of a fifth embodiment of the invention shown in the open position over a strap button.

In FIGS. 33 & 34 are side sectioned views of the fifth embodiment of the locking strap mechanism 510, sectioned through a vertical plane oriented along the front to rear axis and centered on the device from side to side. Only one side of the locking strap mechanism 510 is shown because the opposite side is a mirror image. In FIG. 33 is a side sectioned view of the fifth embodiment of the strap lock mechanism 510 shown attached to a strap 511 and in the locked position over a strap button 530. In the locked position, the wide upper portion of the strap button 530 is inserted into the u-shaped slot 519 so that the u-shaped slot 519 engages the narrow portion of the strap button 530. When in the locked position, the strap button 530 is still capable of a limited amount of motion relative to the strap lock mechanism 510 and is free to rotate relative to the strap lock mechanism 510. The retainer pin 561 is at its lowest position in FIG. 33, however, the bottom of the retainer pin 561 need only extend below a plane even with the top of the strap button 530 to lock it into place. The retainer pin 561 is fixed to the knob 562 and the assembly is pushed downward by the spiral spring 563. The assembly is stopped in the downward direction when the bottom of the knob 562 contacts the top of the fastener 564.

In FIG. 34 is a side sectioned view of the fifth embodiment of the strap lock mechanism 510 shown attached to a strap 511 and in the open position over a strap button 530. The wide upper portion of the strap button 530 is inserted into the u-shaped slot 519 so that the u-shaped slot 519 engages the narrow middle portion of the strap button 530. The retainer pin 561 is in the raised position, which can be effectuated by pulling the knob 562 in the direction denoted by arrow 568. The retainer pin 561 is stopped from moving further in the upward direction when the top of its wide portion contacts the bottom of the narrow portion of the hole 571 in the fastener 564. With the retainer pin 561 raised, a user would then slide the locking strap mechanism 510 in the direction denoted by arrow 569 to disengage the u-shaped slot 519 from the strap button 530.

Installing the strap lock mechanism 510 onto a strap button 530 can be accomplished using multiple methods. In one method, a user lifts the knob 562 relative to the body 560, placing the retainer pin 561 at or near its upward limit of motion. A user then places the strap lock mechanism 510 over a strap button 530 so that the top of the strap button 530 is located substantially below the locking pin 561 and at the open end of the u-shaped opening 519. The user then slides the strap lock mechanism 510 in the opposite direction of the direction denoted by arrow 569 to slide the strap button 530 into the u-shaped slot 519. Once the strap button 530 is fully seated in the u-shaped slot 519 and the strap button 530 no longer prevents the retainer pin 561 from moving downward, the knob 562 may be released, allowing the retainer pin 561 to snap down to its lowest position.

Pulling up on the knob 562 is not necessary when inserting a strap button 530 into the locking strap mechanism 510. A user may use a method where the strap lock mechanism 510 automatically latches onto the narrow middle portion of the strap button 530. Many strap buttons are fixed to an instrument using a screw 532 with a flat head so that the head of the screw and the top edge of the strap button form a substantially flat surface. By lowering the mechanism 510 down onto the strap button 530 such that the bottom of the retainer pin 561 hits the top of the strap button 530 and/or the screw 532, the retainer pin 561 will be pushed upward. When the weight of the instrument pulls the strap button 530 down into the u-shaped slot 519, the retainer pin 561 snaps back out automatically to lock the strap button 530 in place. Because most strap buttons have a countersunk hole at their center to accept a screw, this method can also work on strap buttons where the head of the screw 532 is recessed below the top edge of the strap button 530. If the screw 532 is recessed, the bottom of the retainer pin 561 would still slide over the countersunk surface due to its conical shape.

The strap lock mechanism 510 may alternatively be installed onto a strap button 530 with a substantially flat top surface by manually sliding the strap lock mechanism 510 over the strap button 530 rather than using the instrument's weight. In this automatically latching method, a user starts by placing the strap lock mechanism 510 over a strap button 530 so that the strap button 530 is located substantially below the retainer pin 561 and adjacent to the opening of the u-shaped opening 519. The user then presses down on any portion of the strap lock mechanism 510 other than the knob 562 to push the retainer pin 561 upward with the top of the strap button 530 and/or the screw 532 head. With the retainer pin 561 at or near its upper limit of travel, the user then slides the strap lock mechanism 510 in the opposite direction of the direction denoted by arrow 569 to slide the strap button 530 into the u-shaped slot 519. Once the strap button 530 is fully seated in the u-shaped slot 519 and the strap button 530 no longer prevents the retainer pin 561 from moving downward, the spring 563 will push the retainer pin 561 downward to its lowest position. This automatically latching method also works on strap buttons where the head of the screw 532 is recessed below the top edge of the strap button 530 because the bottom of the retainer pin 561 can slide over the conical countersunk surface.

What has been described is a locking mechanism for attaching a strap to the strap button of a musical instrument. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

The invention claimed is:

1. A strap lock apparatus for attaching a strap to a strap button on a musical instrument, which comprises:

a lower arm, which at a first end is rotatably coupled to the first end of an elongate upper arm at a point of rotation that is configured to allow rotation along one axis;

where, at its distal end, the lower arm is further comprised of a slot configured to accept a strap button;

where, at its distal end, the upper arm is further comprised of a downward facing protrusion extending in a direction substantially normal to the long axis of the upper arm;

where the upper arm is configured to rotate relative to the lower arm and has an equilibrium position relative to the lower arm; and a means coupled to the lower arm and upper arm capable of causing the upper arm to rotate relative to the lower arm to the equilibrium position.

2. A strap lock apparatus as reciting in claim 1 wherein the strap button is generally cylindrical in shape with a first diameter at its top and a second diameter below its top that is less than the first diameter; and wherein the width of the slot is less than the first diameter of the strap button and greater than the second diameter of the strap button.

3. A strap lock apparatus as recited in claim 2 wherein the slot is closed on three sides, open in the direction from the point where the lower arm and upper arm are coupled and facing the distal end of the lower arm, and open in the up and down directions.

4. A strap lock apparatus as recited in claim 3 wherein the lower arm and upper arm are comprised of a single, continuous piece of material.

5. A strap lock apparatus for attaching a strap to a strap button on a musical instrument, which comprises:

a lower arm, which at a first end is rotatably coupled to the first end of an upper arm at a point of rotation that is configured to allow rotation along one axis;

where, at its distal end, the lower arm is further comprised of a slot configured to accept a strap button;

where, between the first end and its distal end, the upper arm is further comprised of a downward facing substantially circular opening oriented in a direction substantially normal to the long axis of the upper arm;

where the upper arm is configured to rotate relative to the lower arm; and a spring means coupled to the lower arm and upper arm capable of causing the distal end of the upper arm to rotate towards the distal end of the lower arm.

6. A strap lock apparatus as reciting in claim 5 wherein the strap button is generally cylindrical in shape with a first diameter at its top and a second diameter below its top that is less than the first diameter; and wherein the width of the slot is less than the first diameter of the strap button and greater than the second diameter of the strap button.

7. A strap lock apparatus as recited in claim 6 wherein the slot is closed on three sides, open in the direction from the point where the lower arm and upper arm are coupled and facing the distal end of the lower arm, and open in the up and down directions.

8. A strap lock apparatus as recited in claim 7 wherein the circular opening of the upper arm is a larger diameter than the first diameter of the strap button.

9. A strap lock apparatus as recited in claim 8 wherein the slot is further comprised of a semicircular portion at a closed end defined by the three closed sides with a radius greater than half of the second diameter of the strap button.

10. A strap lock apparatus as recited in claim 9 wherein a strap button is seated in the slot when the longitudinal axis of the strap button is located substantially at the center of the semicircular portion of the slot; and where the circular opening of the upper arm is configured to be substantially concentric with the strap button when the strap button is seated in the slot.

11. A strap lock apparatus as recited in claim 10 wherein the distal end of the upper arm is further comprised of a protrusion extending in at least the lateral direction.

12. A strap lock apparatus as recited in claim 11 wherein the first end of the upper arm is further comprised of a protrusion extending in at least the lateral direction.

13. A strap lock apparatus for attaching a strap to a strap button on a musical instrument, which comprises:

a body with an upper side and a lower side, further comprising a slot on its lower side open in a lateral direction and a cylindrical opening with a longitudinal axis oriented along the vertical axis;

a retaining pin with a top and bottom, substantially the same longitudinal axis as the cylindrical opening in the body and configured to slide in the axial direction from a first position to a second position;

where the first position is characterized by when the bottom of the retaining pin is located below the bottom surface of the body and the second position is characterized by when the bottom of the retaining pin is located above the first position; and a spring means for pushing the bottom of the retaining pin to the first position.

14. A strap lock apparatus as reciting in claim 13 wherein the strap button is generally cylindrical in shape with a first diameter at its top and a second diameter below its top that is less than the first diameter;

where the width of the slot is less than the first diameter of the strap button and greater than the second diameter of the strap button; and where the slot is offset downward below the body so that the distance between the slot and the body is greater than the vertical distance between the location of the first diameter on the strap button and the second diameter on the strap button.

15. A strap lock apparatus as recited in claim 14 wherein the slot is closed on three sides, open in the lateral direction facing towards the cylindrical hole in the body, and open in the up and down directions.

16. A strap lock apparatus as recited in claim 15 wherein the slot is further comprised of a semicircular portion at a closed end defined by the three closed sides with a radius greater than half of the second diameter of the strap button.

17. A strap lock apparatus as recited in claim 16 wherein the longitudinal axis of retaining pin is located a distance from the center of the semicircular portion of the slot that is greater than the sum of the radius of the retaining pin and the radius of the semicircular portion.

18. The strap lock apparatus as recited in claim 17 wherein the cylindrical opening in the body is further comprised of a threaded internal wall configured to accept the corresponding threads of a fastener; and where the fastener is further comprised of a shaft portion characterized by a threaded exterior and a smooth cylindrical opening with substantially the same longitudinal axis as the cylindrical opening in the body, and a head with sides configured to fit within a socket configured to transmit torque to the fastener and a counterbored portion with substantially the same longitudinal axis as the cylindrical opening in the body.

19. A strap lock apparatus as recited in claim 18 further comprising a knob fixed to the top of the retaining pin, where the bottom of the knob is further comprised of a socket configured to turn the head of the fastener and freely slide over the head of the fastener in the axial direction.

20. A strap lock apparatus as recited in claim 19 where said spring means is further comprised of a spiral spring coupled to the retaining pin on one end and coupled to the fastener on another end.

* * * * *